US008159435B2

(12) United States Patent
Hirayama

(10) Patent No.: US 8,159,435 B2
(45) Date of Patent: Apr. 17, 2012

(54) ACTIVE MATRIX TYPE DISPLAY DEVICE WHICH COMPENSATES FOR AN ELECTRICAL POTENTIAL VARIATION CAUSED BY INTER-PIXEL PARASITIC CAPACITANCE BETWEEN TWO ADJACENT PIXELS CONNECTED TO DIFFERENT SIGNAL LINES

(75) Inventor: Ryuichi Hirayama, Musashimurayama (JP)

(73) Assignee: Casio Computer Co., Ltd., Tokyo (JP)

( * ) Notice: Subject to any disclaimer, the term of this patent is extended or adjusted under 35 U.S.C. 154(b) by 796 days.

(21) Appl. No.: 11/904,637

(22) Filed: Sep. 27, 2007

(65) Prior Publication Data

US 2008/0284776 A1 Nov. 20, 2008

(30) Foreign Application Priority Data

Sep. 29, 2006 (JP) ..... 2006-268950

(51) Int. Cl.
*G09G 3/36* (2006.01)

(52) U.S. Cl. ..... 345/89

(58) Field of Classification Search ..... 345/58, 345/89, 690; 348/223.1, 225.1
See application file for complete search history.

(56) References Cited

U.S. PATENT DOCUMENTS 6,075,505 A 6/2000 Shiba et al.
6,075,507 A * 6/2000 Miyahara et al. ..... 345/89
6,259,504 B1 7/2001 Shin et al.
6,552,707 B1 4/2003 Fujiyoshi
2001/0043180 A1* 11/2001 Mori et al. ..... 345/87
2004/0183768 A1 9/2004 Yamato et al.
2004/0196232 A1 10/2004 Kim et al.
2005/0168424 A1* 8/2005 Nakamoto et al. ..... 345/89
2005/0225545 A1 10/2005 Takatori et al.
2005/0231455 A1* 10/2005 Moon ..... 345/89
2005/0243044 A1 11/2005 Kang et al.

(Continued)

FOREIGN PATENT DOCUMENTS

JP 05-265045 A 10/1993

(Continued)

OTHER PUBLICATIONS

Japanese Office Action dated Jan. 20, 2009 (2 pages), and English translation thereof (3 pages) issued in counterpart Japanese Application No. 2006-268950.

(Continued)

*Primary Examiner* — Chanh Nguyen
*Assistant Examiner* — John Kirkpatrick
(74) *Attorney, Agent, or Firm* — Holtz, Holtz, Goodman & Chick, PC

(57) ABSTRACT

An active matrix type display device in which one signal line is provided for every two pixels along a given direction and in which two pixels adjacent in the given direction on respective sides of one signal line share the signal line and are connected to respective different scanning lines, through switching elements. A scanning line driving circuit selects the plurality of scanning lines in turn, and a signal line driving circuit outputs signals according to information to be displayed to the plurality of signal lines. The scanning line driving circuit simultaneously selects two scanning lines corresponding to two pixels connected to different signal lines and adjacently disposed in the given direction and then selects only one scanning line corresponding to a pixel to be selected later out of the two pixels for only a prescribed period.

12 Claims, 15 Drawing Sheets

U.S. PATENT DOCUMENTS

2008/0238898 A1 10/2008 Yamanaka et al.

FOREIGN PATENT DOCUMENTS

| | | | | |
|---|---|---|---|---|
| JP | 8-201769 | A | | 8/1996 |
| JP | 8-320674 | A | | 12/1996 |
| JP | 10-073843 | A | | 3/1998 |
| JP | 10-171412 | A | | 6/1998 |
| JP | 11-295759 | A | | 10/1999 |
| JP | 11-326869 | A | | 11/1999 |
| JP | 2002258813 | A | * | 9/2002 |
| JP | 2004-185006 | A | | 7/2004 |
| JP | 2005-202377 | A | | 7/2005 |
| JP | 2005-309437 | A | | 11/2005 |
| KR | 2005-0101672 | A | | 10/2005 |

OTHER PUBLICATIONS

Korean Office Action (and English translation thereof) dated Sep. 10, 2008, issued in a counterpart Korean Application.

Japanese Office Action (and English translation thereof) dated Sep. 24, 2008, issued in a counterpart Japanese Application.

Related, co-pending U.S. Appl. No. 12/075,729, filed Mar. 13, 2008, Inventors: Shigeru Yamanaka et al, Title: Driving Circuit and Driving Method of Active Matrix Display Device, and Active Matrix Display Device.

Chinese Office Action dated Feb. 5, 2010 (and English translation thereof), which issued in Chinese Application No. 2008101003389, which is a counterpart Chinese application of *related* U.S. Appl. No. 12/075,729.

* cited by examiner

K0-K255 DOES NOT DEPEND ON POL PHASE,
K0 IS HIGH, AND K255 IS LOW ELECTRICAL POTENTIAL

FIG.6A

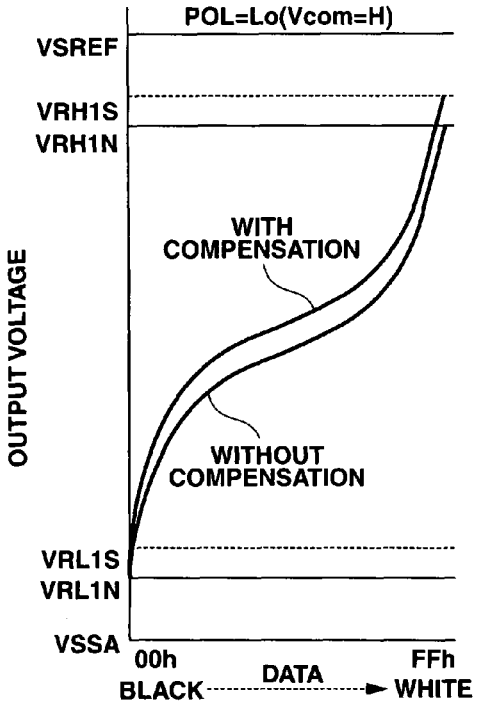

FIG.6B

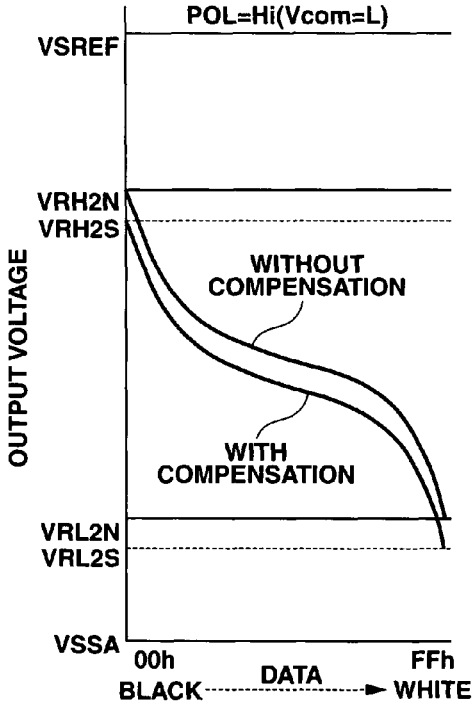

FIG.6C

| AMPLITUDE ADJUSTMENT SIGNAL | DSHIFT [2]=0 | | DSHIFT [2]=1 | |
|---|---|---|---|---|
| | FIRST HALF (G1STH=H) | SECOND HALF (G1STH=L) | FIRST HALF (G1STH=H) | SECOND HALF (G1STH=L) |
| VRL1 | VRL1S | VRL1N | VRL1N | VRL1S |
| VRH1 | VRH1S | VRH1N | VRH1N | VRH1S |
| VRH2 | VRH2S | VRH2N | VRH2N | VRH2S |
| VRL2 | VRL2S | VRL2N | VRL2N | VRL2S |
| | (WITH COMPENSATION) | (WITHOUT COMPENSATION) | (WITHOUT COMPENSATION) | (WITH COMPENSATION) |

FIG.6D

| DSHIFT [1] | DSHIFT [1] | SHIFT AMOUNT |
|---|---|---|
| 0 | 0 | 0mV |
| 0 | 1 | 20mV |
| 1 | 0 | 40mV |
| 1 | 1 | 60mV |

SHIFT AMOUNT=VRH1S-VRH1N
=VRL1S-VRL1N
=VRH2N-VRH2S
=VRL2N-VRL2S

ACTIVE MATRIX TYPE DISPLAY DEVICE WHICH COMPENSATES FOR AN ELECTRICAL POTENTIAL VARIATION CAUSED BY INTER-PIXEL PARASITIC CAPACITANCE BETWEEN TWO ADJACENT PIXELS CONNECTED TO DIFFERENT SIGNAL LINES

CROSS-REFERENCE TO RELATED APPLICATIONS

This application is based upon and claims the benefit of priority from prior Japanese Patent Application No. 2006-268950, filed Sep. 29, 2006, the entire contents of which are incorporated herein by reference.

BACKGROUND OF THE INVENTION

1. Field of the Invention

The present invention relates to an active matrix type display device in which two adjacent pixels share one signal line, and a driving method of the display device.

2. Description of the Related Art

In recent years, an active matrix type display device using a thin-film transistor (TFT) as a switching element has been developed.

The display device includes a scanning line driving circuit (gate driver) which generates scanning signals in order to scan, in turn by row, a plurality of pixels arranged in a matrix form. The gate driver operates at an operation frequency lower than that of a signal line driving circuit (source driver) which supplies video signals to each of the pixels. Therefore, even if the gate driver is formed at the same time in the same process as that to form TFTs corresponding to each of the pixels, the gate driver can satisfy its specification.

Each pixel of the display device has a pixel electrode connected to a TFT, and a common electrode (common to all of the pixels) to which a common voltage Vcom is applied. In the active matrix type display device, to prevent deterioration of liquid crystals caused by sustained application of an electric field in one direction, inversion driving to invert polarities of a video signal Vsig from the source driver against the common voltage Vcom for each frame, line or dot has been performed generally.

Meanwhile, in mounting the display device, the gate driver and the source driver are disposed around a display panel (display screen), which has a large number of pixels disposed thereon. Wiring lines to electrically connect scanning lines (gate lines), and signal lines (source lines) on the display screen to the gate driver and the source driver are routed around the outside the display screen. At this time, it is strongly desired to make a routing area of the wiring lines smaller, that is, to achieve a reduction in area other than the display panel (i.e., to narrow the picture frame) from a point of view of miniaturizing information equipment having an active matrix display device built-in.

Therefore, in particular, a configuration of pixel wiring lines with half the number of source lines has been developed because the area occupied by the source lines can be made smaller, in order to narrow the picture frames of the display panel in the vertical direction (e.g., as shown in FIG. 5 of Jpn. Pat. Appln. KOKAI Publication No. 2004-185006).

FIG. 10 is a schematic view of an example of pixel wiring lines on a display screen to achieve such a narrowed picture frame. This example shares one source line with two adjacent pixels 100. In this case, TFTs 102 of the two adjacent pixels 100 (in the same row) are connected to respective different gate lines. In FIG. 10, for example, the TFT 102 of the pixel 100 in red (R) at the upper left is connected to a gate line G1 and a source line S1, and the TFT 102 of the neighboring pixel 100 in green (G) to the right is connected to a gate line G2 and the source line S1.

FIG. 11 illustrates the order of writing video signals Vsigs to each pixel 100 using the pixel wiring arrangement shown in FIG. 10. As illustrated in FIG. 11, the writing of the video signals Vsigs to each pixel 100 is executed in the order of the gate lines.

In the structure of the pixel wiring lines described above in which the number of the source lines is reduced by half, some adjacent columns of pixels have a source line therebetween, and other adjacent columns of pixels do not have a source line therebetween. As illustrated in the equivalent circuit of FIG. 12, at the points without source lines between pixels, there is parasitic capacitance between the pixels that is larger than at points where a source line is provided between adjacent pixels Among pixels having inter-pixel parasitic capacitance 104, voltage leakages occur, and as a result the electrical potential at the pixel 100 written first varies under the influence of the voltage at the pixel 100 written later. The variation in voltage appears as display unevenness on the screen. Since order of writing is fixed as depicted in FIG. 11, the display unevenness caused by the leakage always occurs at the same point.

FIG. 13 is a view illustrating an example of the display unevenness. FIG. 13 illustrates the display unevenness only of the pixels 100 of G so as to make the example clearly understandable. Here, the scanning order of the gate lines is expressed as G1, G2, G3, . . . , G8. At the pixels 100 of other colors which are depicted in a ground color black in FIG. 13, the electrical potential of the pixels 100 written first varies in a similar manner (described in detail later).

FIG. 14 shows configurations of each pixel when the display panel is a TFT liquid crystal display (LCD). Each pixel 100 is configured such that a liquid crystal (not shown) is held between the common electrode to which the common voltage Vcom is to be applied (not shown) and the pixel electrode connected to a source line through a TFT 102 which is also connected with a gate line. Holding electric charge at a liquid crystal capacitor Clc over a field period (frame period in the case of a non-interlace system) achieves the corresponding display. As a countermeasure against current leakage through the capacitor Clc and the TFT, an auxiliary capacitor Cs is disposed in parallel with the capacitor Clc.

FIG. 15A is a view illustrating a scanning timing chart of gate lines G1-G4 by means of the gate drivers in FIG. 14. FIG. 15B is a view illustrating pixel electrical potential waveforms of a pixel F (see FIG. 12) in green connected, for example, to the source line S3 and written first (pixel "G-first"), and of a pixel L (see FIG. 12) in red connected, for example, to the source line S2 and written later ("R-later").

Hereinafter, the case of a liquid crystal display device in a normally white mode that reduces a transmission factor (becomes dark) as the voltage applied to the pixel becomes larger will be described. FIG. 15B shows the case in which the amplitude of the common voltage Vcom is set to 5.0V, the voltage to write the pixel F (G-first) (video signal Vsig) is set to 2.0V against the common voltage Vcom (intermediate tone), and the voltage to write the pixel L (R-later) (video signal Vsig) is set to 4.0V against the common voltage Vcom (black, dark). Since the influence of drawing voltage (field through voltage) ΔV generated when the TFT 102 is switched from on to off can be cancelled through adjustment of the common voltage Vcom (shift Vcom downward by ΔV), the influence is not illustrated at the waveform in FIG. 15B (the same applies to figures of other pixel electrical potential waveforms described later).

As shown in FIG. 15A, in each field, two gate lines are selected in one horizontal period, and the selected two gate lines are scanned in turn for every horizontal period. As depicted in FIG. 15B, the TFTs 102 connected to the selected gate lines turn on, and the video signals Vsigs applied from the source lines to the corresponding pixels 100 are written. Accordingly, the write timing of the pixel F (G-first) becomes $W_G$ in FIG. 15B and the write timing of pixel L (R-later) becomes $W_R$. The pixel electrical potentials written at these timings $W_G$ and $W_R$ are maintained until those pixels are re-written in the next field.

FIG. 15B illustrates pixel electrical potential waveforms in an ideal state when the inter-pixel parasitic capacitance 104 is "0". However, as mentioned above, the inconvenience of the occurrence of the capacitance 104 is generated at the point with no source line. FIG. 16A is a view illustrating the pixel electrical potential waveforms under the same voltage conditions as those of FIG. 15B by taking the capacitance 104 into consideration. FIG. 16B is a view illustrating the pixel electrical potential waveform in the case in which the amplitude of the common voltage Vcom is set to 5.0V, the write voltage of the pixel F (G-first) is set to 2.0V against the common voltage Vcom, and the write voltage of the pixel L (R-later) is set to 1.0V (white, bright), when the capacitance 104 is taken into account.

As shown in FIG. 16A and FIG. 16B, at the pixel F (G-first), the pixel electrical potential written by selecting the gate line G1 shifts to the direction going away from the common voltage Vcom (direction getting dark) by an electrical potential variation Vc in writing the pixel L (R-later) by selecting the gate line G2. The height of the variation Vc is expressed by the following equation (Eq.) (1):

$$Vc=(Vsig(F_{n-1})+Vsig(F_n))\times Cpp/(Cs+Clc+Cpp)\times\alpha \quad (1)$$

In Eq. (1), "$Vsig(F_n)$" is the write voltage of the pixel L (R-later) in a current field, and "$Vsig(F_{n-1})$" is the write voltage of the pixel L (R-later) in the preceding field. Therefore, in the case of FIG. 16A, "$Vsig(F_{n-1})+Vsig(F_n)=8.0V$" is satisfied, and in the case of FIG. 16B, "$Vsig(F_{n-1})+Vsig(F_n)=2.0V$" is satisfied. Cpp is a capacitance value of the parasitic capacitance 104, Cs is a capacitance value of the auxiliary capacitance Cs, Clc is a capacitance value of the liquid crystal capacitance Clc, and $\alpha$ is a proportional factor which value is determined in accordance with a panel structure, etc.

As described above, the larger the value of "$Vsig(F_{n-1})+Vsig(F_n)$" is, the larger the value Vc of electrical potential variation becomes, and it does not depend on the magnitude of the amplitude of the common voltage Vcom.

The description above describes the case of the horizontal line inversion driving which differs in polarity of the common voltage Vcom among pixels adjacent to one another in the direction along the source line. That is, the description is the case in which, for instance, in FIG. 11, the horizontal line inversion driving differs in polarity of the common voltage Vcom among the pixels to be connected to the gate line G1 or G2 and the pixels to be connected to the gate line G3 or G4.

To perform the polarity inversion of the common electrode Vcom, a driving method referred to as dot inversion driving is known. In this driving method, the polarity of the common voltage Vcom differs between pixels adjacent to each other in the direction along the source line and between pixels adjacent to each other in the direction along the gate line. For example, in this driving method, the polarity of the common voltage Vcom differs between the pixel connected to gate line G2 and the pixel connected to gate line G3 and the pixel connected to gate line G1 and the pixel connected to gate line G3. In any case of the horizontal line inversion driving and the dot inversion driving, the polarities of the common voltages Vcoms at the respective pixels are inverted for each frame.

FIGS. 17A and 17B show the case of performing the dot inversion driving. Here, FIG. 17A illustrates the pixel electrical potential waveforms in the case in which the amplitude of the common voltage Vcom is set to 5.0V, the write voltage of the pixel F (G-first) is set to 2.0V (intermediate tone) against the common voltage Vcom, and the write voltage of the pixel L (R-later) is set to 4.0V (black) against the common voltage Vcom, taking the inter-pixel parasitic capacitance 104 into account. FIG. 17B illustrates the pixel electrical potential waveforms in the case in which the amplitude of the common voltage Vcom is set to 5.0V, the write voltage of the pixel F (G-first) is set to 2.0V against the common voltage Vcom, and the write voltage of the pixel L (R-later) is set to 1.0V (white) against the common voltage Vcom, taking the inter-pixel parasitic capacitance 104 into account.

As shown in FIGS. 17A and 17B, also when performing the dot inversion driving, in the same way as performing the horizontal line inversion driving, at the pixel F of G-first, in writing the pixel L of R-later by selecting the gate line G2, the pixel electrical potential, being written by selecting the gate line G1, shifts by the variation Vc.

Also in such a case, the larger the value of "$Vsig(F_{n-1})+Vsig(F_n)$" is, the larger the value Vc of the electrical potential variation becomes, and the variation Vc does not depend on the amplitude of the common voltage Vcom as in the case of the horizontal line inversion driving.

In the horizontal line inversion driving, the potential variation occurs in such a manner as to increase the potential difference between the common voltage Vcom and the write voltage. In the dot inversion driving, in contrast, the potential variation occurs in such a manner as to decrease the potential difference between the common voltage Vcom and the write voltage.

In the normally white mode, wherein "white" is displayed when no voltage is applied and "black" is displayed when voltage is applied, the variations of Vc as given above result in making the pixel G-first darker than the actual display of the pixel in the case of the horizontal line inversion driving. In the case of the dot inversion driving, the variations described above result in making the pixel G-first brighter that the actual one. In contrast, since a normal voltage for the pixel electrical potential of the pixel G-later is written, displaying like a G raster results in displays of alternate bright and dark lines in a longitudinal direction also in both inversion driving.

Similar variations of the variation Vc also occur at the pixel R-first and at the pixel B-first.

The situation given above is not limited in the case of a strip arrangement of the pixels 100, and the same goes as the case of a delta arrangement.

The method disclosed by the foregoing Jpn. Pat. Appln. KOKAI Publication No. 2004-185006 cannot deal with the problem of display unevenness due to the electrical potential variations generated at the previously written pixels caused by such inter-pixel parasitic capacitance 104.

BRIEF SUMMARY OF THE INVENTION

The present invention is made in view of such conventional problems, and an object thereof is to reduce display unevenness caused by inter-pixel parasitic capacitance.

According to one aspect of the invention, an active matrix type display device includes: a first pixel and a second pixel arranged adjacent to each other along a given direction; a third pixel adjacent to the first pixel along the given direction on an opposite side of the first pixel from the second pixel; a fourth pixel adjacent to the second pixel along the given direction on an opposite side of the second pixel from the first pixel; a first signal line interposed between the first pixel and the third pixel, which share the first signal line; a second signal line interposed between the second pixel and the fourth pixel, which share the second signal line; a first scanning line to which the first pixel and the fourth pixel are connected; a second scanning line to which the second pixel and the third pixel are connected; and a scanning line driving circuit which simultaneously selects both the first scanning line and the second scanning line for a first period of time, and then selects only the second scanning line for a second period of time.

According to another aspect of the invention, an active matrix type display device includes: a first pixel and a second pixel arranged adjacent to each other along a given direction; a third pixel adjacent to the first pixel along the given direction on an opposite side of the first pixel from the second pixel; a fourth pixel adjacent to the second pixel along the given direction on an opposite side of the second pixel from the first pixel; a first signal line interposed between the first pixel and the third pixel, which share the first signal line; a second signal line interposed between the second pixel and the fourth pixel, which share the second signal line; a first scanning line to which the first pixel and the fourth pixel are connected; a second scanning line to which the second pixel and the third pixel are connected; and a compensation circuit which causes the first or second pixel to output a signal in which a potential variation component originating from a parasitic capacitance between the first and second pixels is compensated for.

According to another aspect of the invention, an active matrix type display device is provided in which one signal line is provided for every two pixels along a given direction and in which two pixels adjacent in the given direction and on respective sides of one signal line share the signal line and are connected to respective different scanning lines, through switching elements. The device includes a scanning line driving circuit which selects the plurality of scanning lines in turn; and a signal line driving circuit which outputs signals according to information to be displayed to the plurality of signal lines, wherein the scanning line driving circuit simultaneously selects two scanning lines corresponding to two pixels connected to different signal lines and adjacently disposed in the given direction and then selects only one scanning line out of the simultaneously selected scanning lines.

According to another aspect of the invention, an active matrix type display device is provided in which one signal line is disposed for every two pixels along a given direction and in which two pixels adjacent in the given direction and on respective sides of the signal line share the signal line and are connected to respective different scanning lines, through switching elements. The device includes: a scanning line driving circuit which selects the plurality of scanning lines in turn; a signal line driving circuit which outputs signals according to information to be displayed to the plurality of signal lines; and a compensation circuit which causes the signal line driving circuit to output a signal compensated by an electrical potential variation caused by inter-pixel parasitic capacitance to one pixel out of two pixels connected to different signal lines and adjacently arranged in the given direction.

According to another aspect of the invention, a driving method is provided of driving an active matrix type display device which includes a display panel which comprises: a plurality of signal lines, a plurality of scanning lines, a plurality of pixels arranged in a matrix, and a plurality of switching elements which are disposed so as to correspond respectively to the plurality of pixels such that each switching element controls the corresponding pixel in accordance with a selection state of a signal line and a scanning line corresponding to the pixel, one signal line being arranged for every two pixels along a given direction, so that two adjacent pixels on respective sides of one signal line share the one signal line. The method includes: selecting simultaneously two scanning lines corresponding to two pixels connected to different signal lines and adjacently disposed in the given direction when outputting a signal according to information to be displayed on the plurality of signal lines while selecting the plurality of scanning lines in turn; and selecting only one scanning line out of the simultaneously selected scanning lines only for a prescribed period.

According to the invention, even if the inter-pixel parasitic capacitance exists, display unevenness can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 6A is a view depicting γ curves in a normal mode and a data shift mode when a polarity signal (POL) in the γ circuit block is L;

FIG. 6B is a view depicting γ curves in a normal mode and a data shift mode when POL in the γ circuit block is H;

FIG. 6C is a view depicting relations of output voltages to amplitude adjustment signals in the data shift mode;

FIG. 6D is a view depicting shift amounts;

DETAILED DESCRIPTION

Hereinafter, preferred forms to put the invention into practice will be described with reference to the drawings.

First Embodiment

Figure 1A:
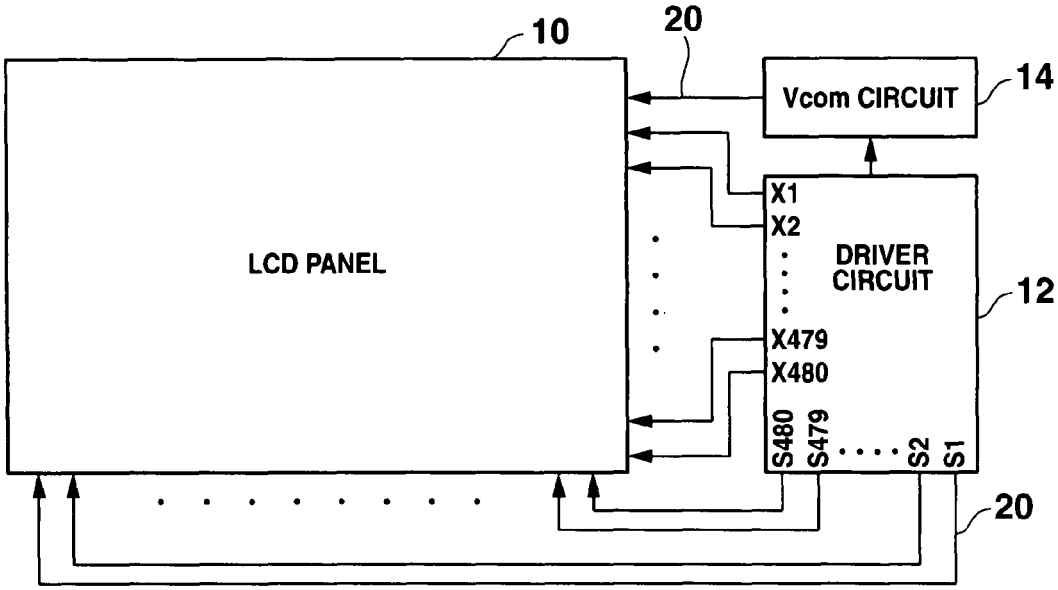
FIG. 1A is a schematic configuration view depicting a whole configuration of a matrix display device according to the first embodiment of the invention.
Figure 1B:
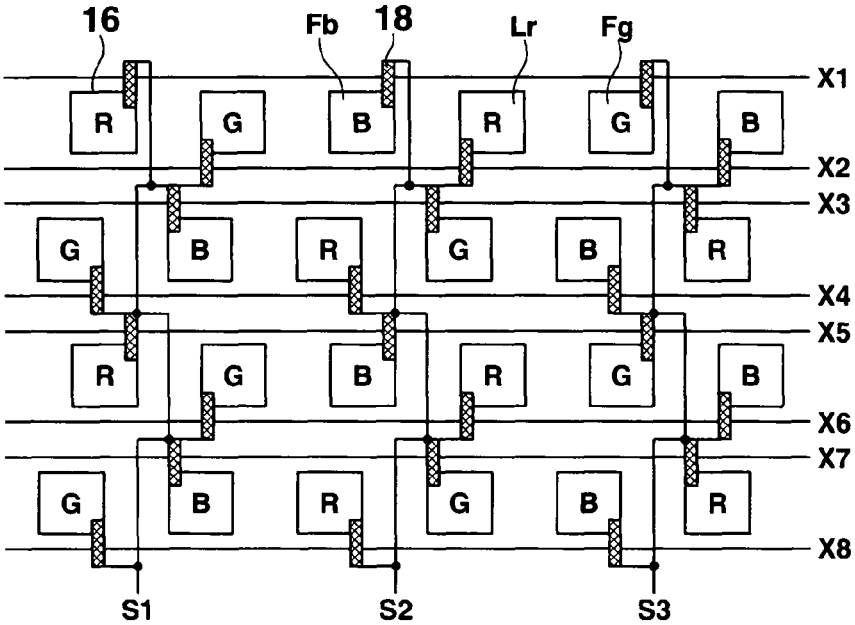
FIG. 1B is a schematic view of pixel wiring lines on an LCD panel.

FIG. 1A is a schematic configuration view of a whole configuration of an active matrix type display device relating to the first embodiment of the invention, and FIG. 1B is a schematic view of pixel wiring lines of an LCD panel in FIG. 1A.

The active matrix type display device according to the first embodiment includes, as shown in FIG. 1A, an LCD panel 10 with a plurality of pixels disposed thereon; a driver circuit 12 to drive-control each pixel of the LCD panel 10; and a Vcom circuit 14 to apply a common voltage Vcom to the LCD panel 10.

On the LCD panel 10, as shown in FIG. 1B, a plurality of pixels 16 are arranged in a matrix form. A plurality of source lines S1-S480 and a plurality of gate lines X1-X480 are arranged so as to intersect with one another. Each pixel is connected to one of the source lines and one of the gate lines, through a TFT 18 as a switching element. Here, each pixel is arranged so that two adjacent pixels 16 share one source line (see FIG. 1B), and such that the respective TFTs 18 corresponding to the two adjacent pixels 16 sharing a source line are connected to different gate lines. In FIG. 1B, for example, the TFT 18 of a pixel 16 (R) at an upper left is connected to a gate line X1 and a source line S1, while the TFT 18 of the adjacent pixel 16 (G) to the right of the pixel at the top left is connected to a gate line X2 and the source line S1. Here, the case in which the pixels 16 are arranged in a delta arrangement is depicted.

The plurality of source lines S1-S480 and gate lines X1-X480 on the LCD panel 10 are electrically connected to the driver circuit 12 by means of wiring 20 routed on a substrate (not shown) of the LCD panel 10.

Figure 2:
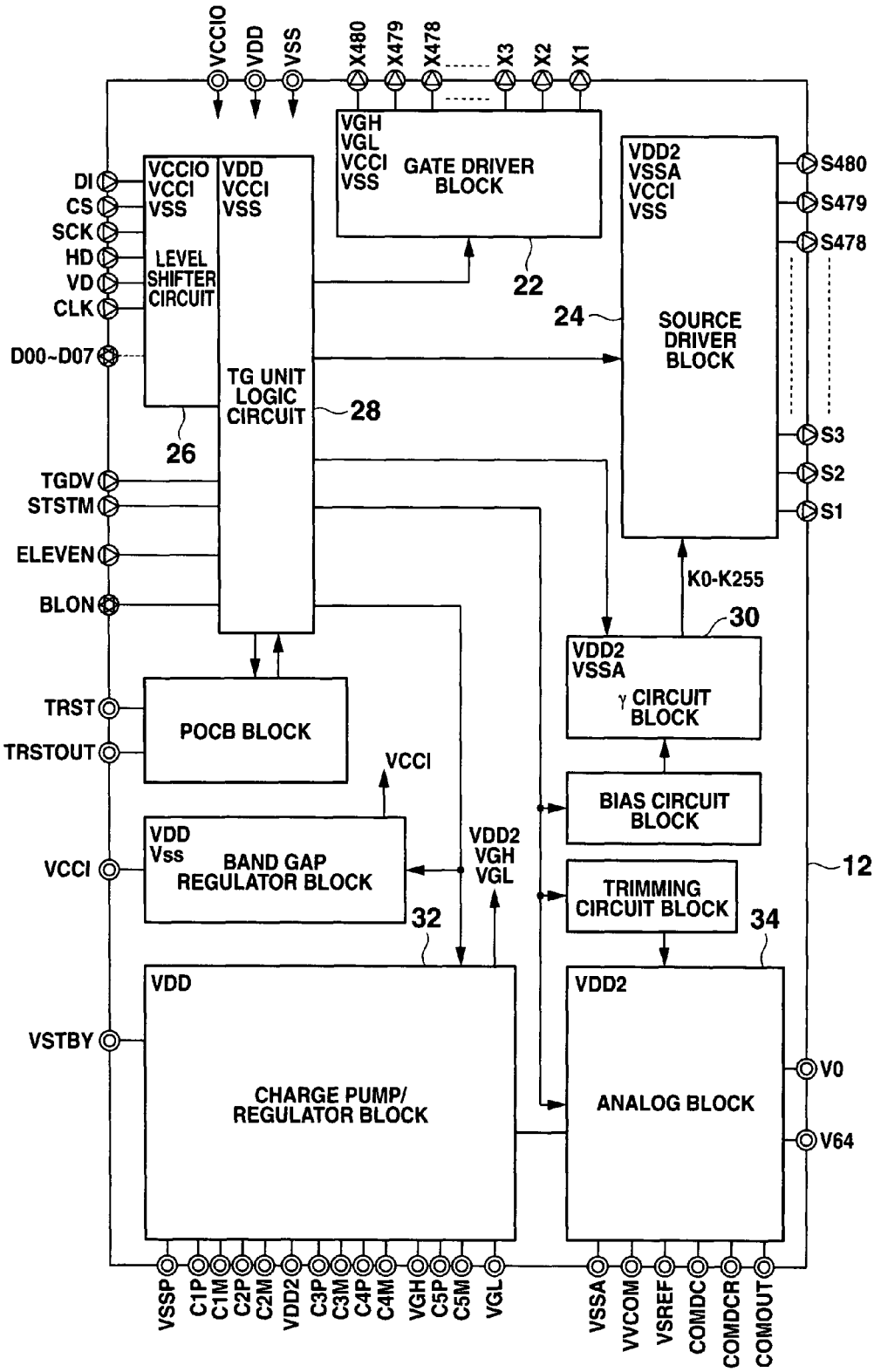
FIG. 2 is a block diagram of a driver circuit.

FIG. 2 is a block diagram of the driver circuit 12 in FIG. 1A. The driver circuit 12 is composed, as depicted in FIG. 2, of a gate driver block 22, a source driver block 24, a level shifter circuit 26, a timing generator (TG) unit logic circuit 28, a gamma (γ) circuit block 30, a charge pump/regulator block 32, an analog block 34, and other blocks.

Here, the gate driver block 22 selects the plurality of gate lines X1-X480 of the LCD panel 10 in turn, and the source driver block 24 outputs video signals Vsig according to the information to be displayed to the plurality of signal lines S1-S480 of the LCD panel 10.

The level shifter circuit 26 makes a level of a signal supplied from outside shift to a prescribed level. The TG unit logic circuit 28 generates necessary timing signals and control signals on the basis of the signals shifted to the prescribed level by the level shifter circuit 26 or on the basis of signals supplied externally to supply the timing and control signals to each unit in the driver circuit 12.

The γ circuit block 30 applies γ compensations so that the video signals Vsig output from the source driver block 24 become excellent in gradation property.

The charge pump/regulator block 32 generates a variety of voltages of necessary logic levels from an external power source, and the analog block 34 further generates a variety of voltages from the voltages generated from charge pump/regulator block 32. The Vcom circuit 14 generates the common voltage Vcom from a voltage VVCOM generated from the analog block 34. In regard to other blocks, they are not directly associated with the invention, and therefore explanations therefore will be omitted.

Figure 3A:
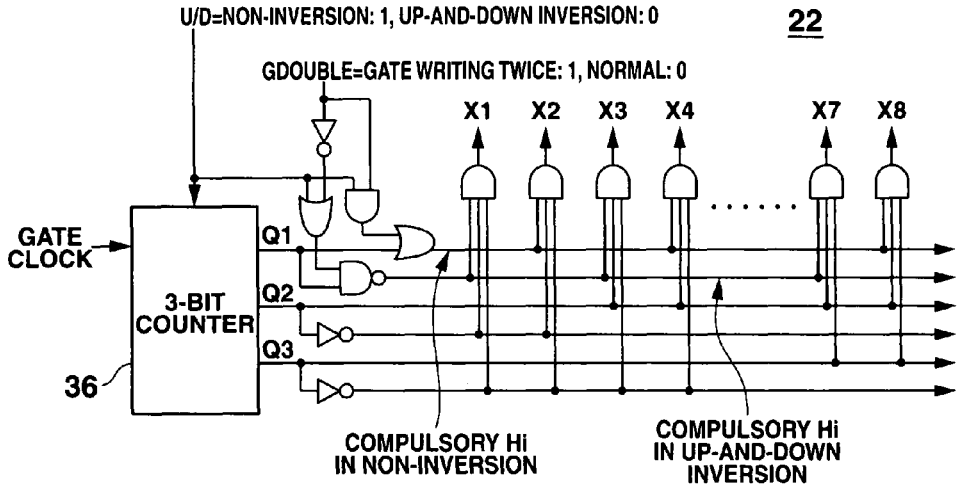
FIG. 3A is a view depicting a configuration of a gate driver block.

FIG. 3A is a view depicting a configuration of the gate driver block 22 in FIG. 2. To simplify the description and figure, eight gate lines will be described herein. In this case, the gate driver block 22 includes a 3-bit counter 36, nine AND gates, two OR gates, three NOT gates, and one NAND gate.

The TG unit logic circuit 28 supplies a gate clock and an up/down (U/D) signal to the 3-bit counter 36. The U/D signal is "1" in non-inversion shift, which is a normal display, and it is "0" in up-and-down inversion shift displaying an up-side-down display. This is because the scanning direction of the gate lines in up-and-down inversion shift is up-side-down with respect to the scanning direction in non-inversion shift, and, as a result, the pixel written first and the pixel written later being inverted with each other, operations have to be switched in response to the results.

A Q1 output from the 3-bit counter 36 is supplied to AND gates for even-numbered gate lines X2, X4, X6 and X8 through one of the OR gates (FIG. 3A). An output signal from an AND gate which conducts a logic calculation between the U/D signal and a gate double (GDOUBLE) signal given from the TG unit logic circuit 28 is also supplied to the OR gate. Here, the GDOUBLE signal is "0" in a normal mode that presents a normal display, and it is "1" in a gate write-twice mode that conducts driving for reducing display unevenness (gate write-twice driving) in this embodiment. The Q1 output from the 3-bit counter 36 is further supplied to AND gates for odd-numbered gate lines X1, X3, X5 and X7 through the NAND gate. An output signal from another OR gate, which performs a logic calculation between the U/D signal and a signal that is the GDOUBLE signal inverted by a NOT gate is also supplied to the NAND gate, and an output from the NAND gate is supplied to the AND gate for the odd-numbered gate lines X1, X3, X5 and X7.

A Q2 output from the counter 36 is supplied to the AND gates for the gate lines X3, X4, X7 and X8, and also supplied to the AND gates for the gate lines X1, X2, X5 and X6 though a NOT gate.

A Q3 output from the counter 36 is supplied to the AND gates for the gate lines X5, X6, X7 and X8, and also supplied to the AND gates for the gate lines X1, X2, X3 and X4 through the NOT gate.

Figure 3B:
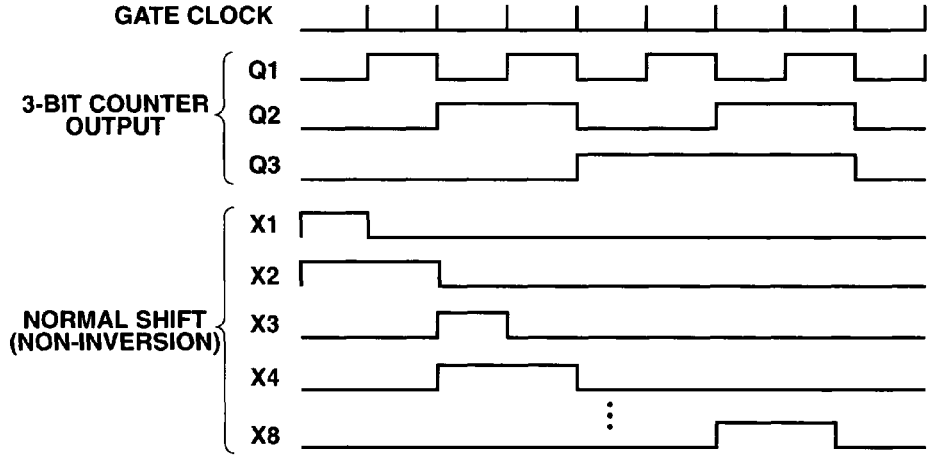
FIG. 3B is a view depicting a timing chart in a non-inversion shift mode in a gate write-twice mode in the gate driver block.
Figure 3C:
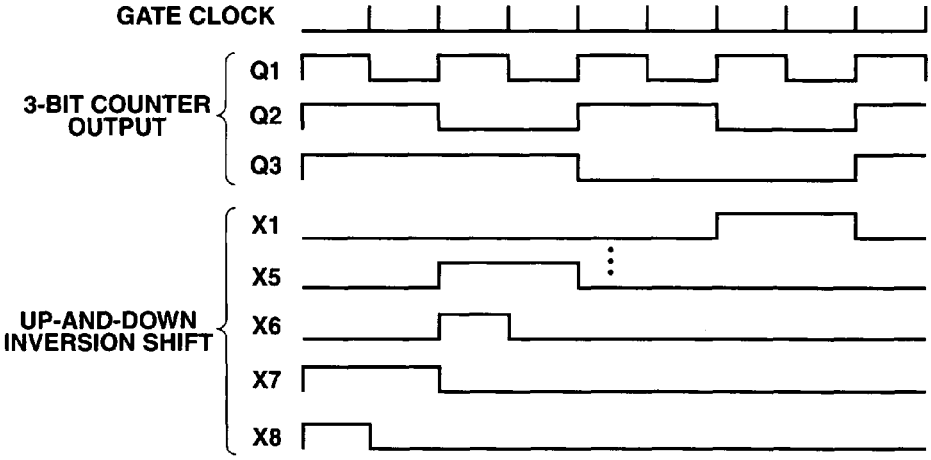
FIG. 3C is a view depicting a timing chart in an up-and-down inversion shift mode in the gate write-twice mode in the gate driver block.

FIG. 3B shows a timing chart in non-inversion shift in the gate write-twice mode with such a configuration of the gate driver block 22. FIG. 3C shows a timing chart in up-and-down inversion shift in the gate write-twice mode (the same mode as in FIG. 3B).

In non-inversion shift, as shown in FIG. 3B, H signals are output in turn, respectively, to the odd-numbered gate lines X1, X3, X5 and X7 for a period equivalent to one pulse of a gate clock, and to the even-numbered gate lines X2, X4, X6 and X8 for two pulses of the gate clock. In other words, in regard to timing, selected states shift as follows: From a state with the gate lines X1 and X2 selected, to a state with the gate line X2 selected, to a state with the gate lines X3 and X4 selected, to a state with the gate line X4 selected, to a state with the gate lines X5 and X6 selected, to a state with the gate lines X6 selected, to a state with the gate lines X7 and X8 selected, and to a state with the gate line X8 selected.

In up-and-down inversion shift, as shown in FIG. 3C, H signals are output in an inverted direction and in turn, respectively, to the even-numbered gate lines X2, X4, X6 and X8 for a period equivalent to one pulse of the gate clock, and to the odd-numbered gate lines X1, X3, X5 and X7 for two pulses of the gate clock. In other words, in regard to timing, selected states shift as follows: From a state with the gate lines X8 and X7 selected, to a state with the gate line X7 selected, to a state with the gate lines X6 and X5 selected, to a state with the gate line X5 selected, to a state with the gate line X4 and X3 selected, to a state with the gate lines X3 selected, to a state with the gate lines X2 and X1 selected, to a state with the gate lines X1 selected.

Figures 4A, 4B, 4C:
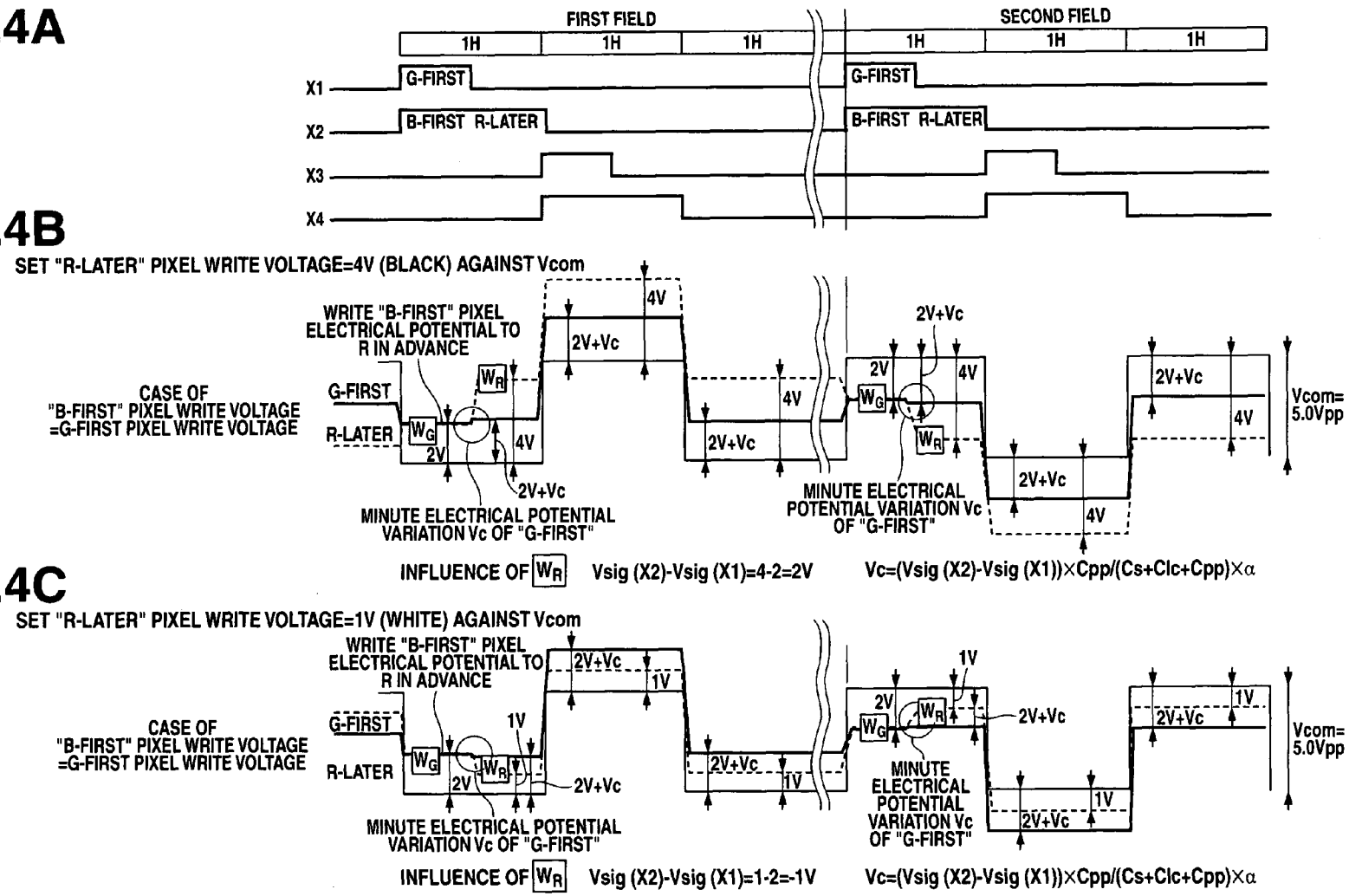
FIG. 4A is a view depicting a scanning timing chart in the non-inversion shift in the gate write-twice mode.
FIG. 4B is a view depicting pixel electrical potential waveforms in the case in which an amplitude of a common voltage is set to 5.0V, a write voltage of a pixel G-first is set to 2.0V against the common voltage, a write voltage of pixel R-later is set to 4.0V against the common voltage, and a write voltage of a pixel B-first is set to 2.0V against the common voltage, in performing horizontal line inversion driving.
FIG. 4C is a view depicting pixel electrical potential waveforms in the case in which an amplitude of a common voltage is set to 5.0V, a write voltage of a pixel G-first is set to 2.0V against the common voltage, a write voltage of pixel R-later is set to 1.0V against the common voltage, and a write voltage of a pixel B-first is set to 2.0V against the common voltage, in performing horizontal line inversion driving.
Figure 15A:
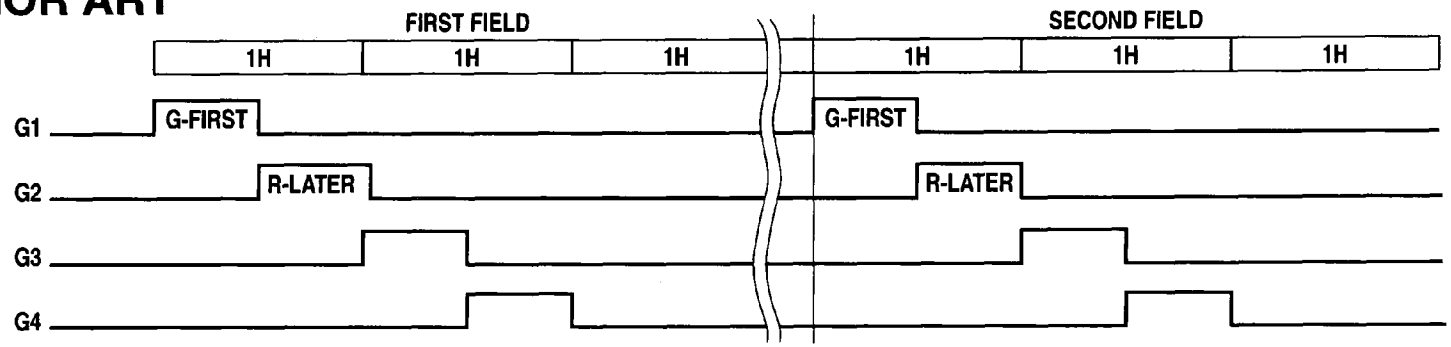
FIG.15A PRIOR ART
FIG. 15A is a view depicting a scanning timing chart.

FIG. 4A is a view illustrating a scanning timing chart in non-inversion shift in a gate write-twice mode in the embodiment corresponding to FIG. 15A.

FIGS. 4B and 4C are views illustrating pixel electrical potential waveforms of a green pixel Fg to be written first and connected to, for example, S3 in FIG. 1B ("G-first pixel"), and of a red pixel Lr to be written later connected to, for example, S2 in FIG. 1B ("R-later pixel") when performing the horizontal line inversion driving to invert the polarities of the common voltages Vcom for every one horizontal period. In this case, as mentioned later, the pixel electrical potential waveforms have a relation to a blue pixel Fb to be selected first ("B-first pixel") connected to, for example, the same line S2 as the red pixel Lr in FIG. 1B.

As shown in FIG. 4A, in non-inversion shift in the gate write-twice mode in the present embodiment, the gate lines are selected as described above with respect to FIG. 3B such that, in each field, after simultaneously selecting two gate lines corresponding to two adjacently arranged pixels connected to different signal lines for one horizontal period, only one gate line is selected corresponding to the pixel to be selected later out of the two pixels.

FIG. 4B is a view illustrating pixel electrical potential waveforms in the case in which the amplitude of the common voltage Vcom is set to 5.0V, the write voltage (video signal Vsig) of the G-first pixel Fg is set to 2.0V (intermediate tone) against the common voltage Vcom, the write voltage (video signal Vsig) of the R-later pixel Lr is set to 4.0V (black) against the common voltage Vcom, and the write voltage (video signal Vsig) of the B-first pixel Fb is set to 2.0V (intermediate tone) against the common voltage Vcom, when performing the horizontal line inversion driving to invert the polarities of the common voltages Vcom for every one horizontal period. Similarly, FIG. 4C is a view illustrating pixel electrical potential waveforms in the case in which the amplitude of the common voltage Vcom is set to 5.0V, the write voltage (video signal Vsig) of the G-first pixel Fg is set to 2.0V (intermediate tone) against the common voltage Vcom, the write voltage (video signal Vsig) of the pixel Lr of R-later is set to 1.0V (white) against the common voltage Vcom, and the write voltage (video signal Vsig) of the B-first pixel Fb is set to 2.0V (intermediate tone) against the common voltage Vcom.

In the first embodiment, the scanning of the gate lines as shown in FIG. 4A applies the write voltage of the B-first pixel Fb also to the R-later pixel Lr for the period that the gate lines X1 and X2 are simultaneously selected because the B-first pixel Fb shares the one source line (signal line) S2 with the R-later pixel Lr as shown in FIGS. 4B and 4C, thereby making the voltage of the R-later pixel Lr become the same as the voltage of the B-first pixel Fb. Then, on selecting only the gate line X2, the write voltage of the R-later pixel Lr is applied to the source line, and then the voltage to be originally written to the R-later pixel Lr is written (instead of the pixel electrical potential at B-first).

Therefore, the first embodiment can suppress the occurrence of the variation Vc expressed by Eq. (1).

However, even in the first embodiment, just like the conventional technique, since the inter-pixel parasitic capacitance Cpp exists, at the G-first pixel Fg, the pixel electrical potential written through the selection of the gate line X1 results in shifting in the direction getting away from the common voltage Vcom (direction getting dark) when only the gate line X2 is selected and the voltage, to be originally written to the R-later pixel Lr is written into the R-later pixel Lr. The magnitude of the newly generated electrical potential variation Vc is expressed as follows:

$$Vc=(Vsig(X2)-Vsig(X1))\times Cpp/(Cs+Clc+Cpp)\times\alpha \quad (2)$$

In Eq. (2), "Vsig(X2)" is the write voltage of R-later pixel Lr when only the gate line X2 is selected, "Vsig(X1)" is the write voltage of the B-first pixel Fb when the gate lines X1 and X2 are selected at the same time, and Cpp, Cs, Clc and α are the same as those of Eq. (1).

In other words, in the first embodiment, the variation Vc is affected by the electrical potential of the pixel Fb that is an adjacent pixel connected to the same signal line, not by the pixel electrical potential in the preceding field. However, for instance, as "Vsig(X2)−Vsig(X1)=4.0−2.0=2.0V" is established in the case of FIG. 4B, and as "Vsig(X2)−Vsig(X1)=1.0−2.0=−1.0V" is established in the case of FIG. 4C, it is clear that the first embodiment can make the absolute value of the electrical potential variation Vc caused from the inter-pixel capacitance Cpp smaller than according to the conventional technique. Therefore, the first embodiment can decrease the display unevenness in comparison with the conventional matrix display device.

Figure 15B:
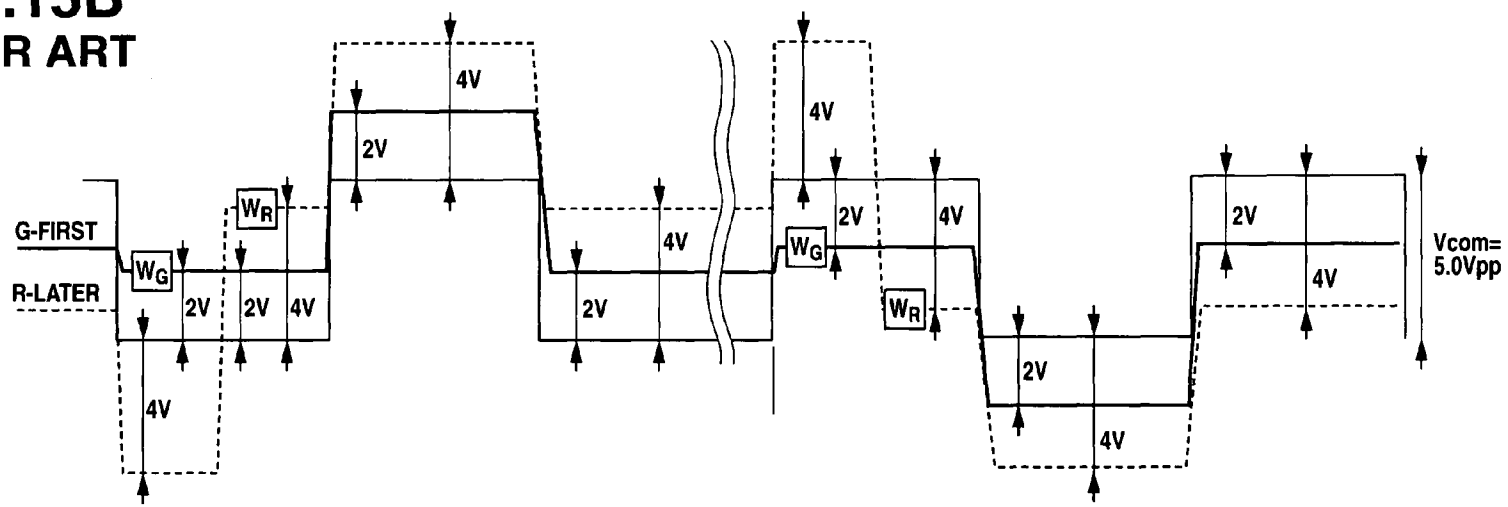
FIG.15B PRIOR ART
FIG. 15B is a view depicting pixel electrical potential waveforms in performing the horizontal line inversion driving in the case in which inter-pixel parasitic capacitance does not exist.
Figure 16A:
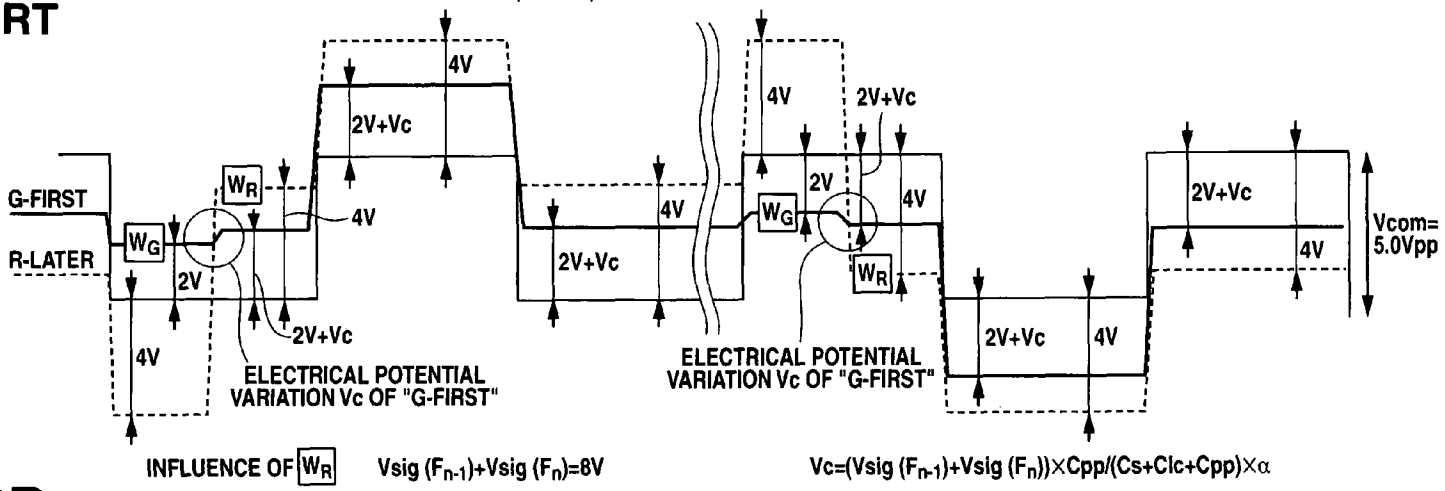
FIG.16A PRIOR ART
FIG. 16A is a view depicting pixel electrical potential waveforms, in which amplitude of a common voltage is set to 5.0V, a write voltage of a pixel G-first is set to 2.0V against the common voltage, and a write voltage of pixel R-later is set to 4.0V against the common voltage, in performing the horizontal line inversion driving under taking inter-pixel parasitic capacitance into account.
Figure 16B:
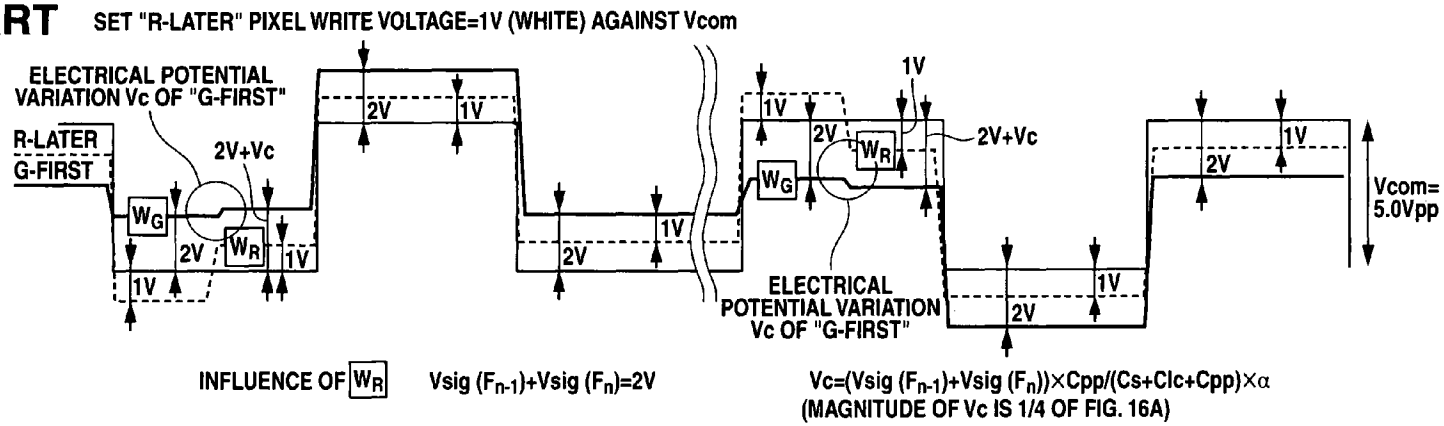
FIG.16B PRIOR ART
FIG. 16B is a view depicting pixel electrical potential waveforms, in which amplitude of a common voltage is set to 5.0V, a write voltage of a pixel G-first is set to 2.0V against the common voltage, and a write voltage of pixel R-later is set to 1.0V against the common voltage, in performing the horizontal line inversion driving under taking inter-pixel parasitic capacitance into account.
Figure 17A:
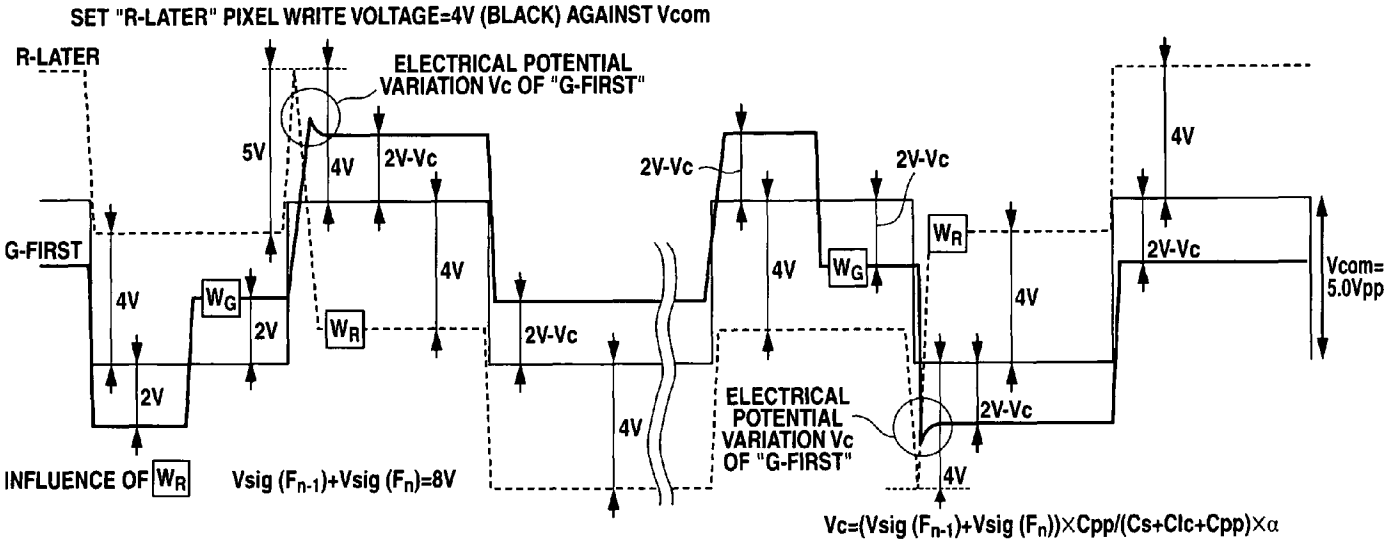
FIG.17A PRIOR ART
FIG. 17A is a view depicting pixel electrical potential waveforms, in which amplitude of a common voltage is set to 5.0V, a write voltage of a pixel G-first is set to 2.0V against the common voltage, and a write voltage of pixel R-later is set to 4.0V against the common voltage, in performing dot inversion driving, taking inter-pixel parasitic capacitance into account.
Figure 17B:
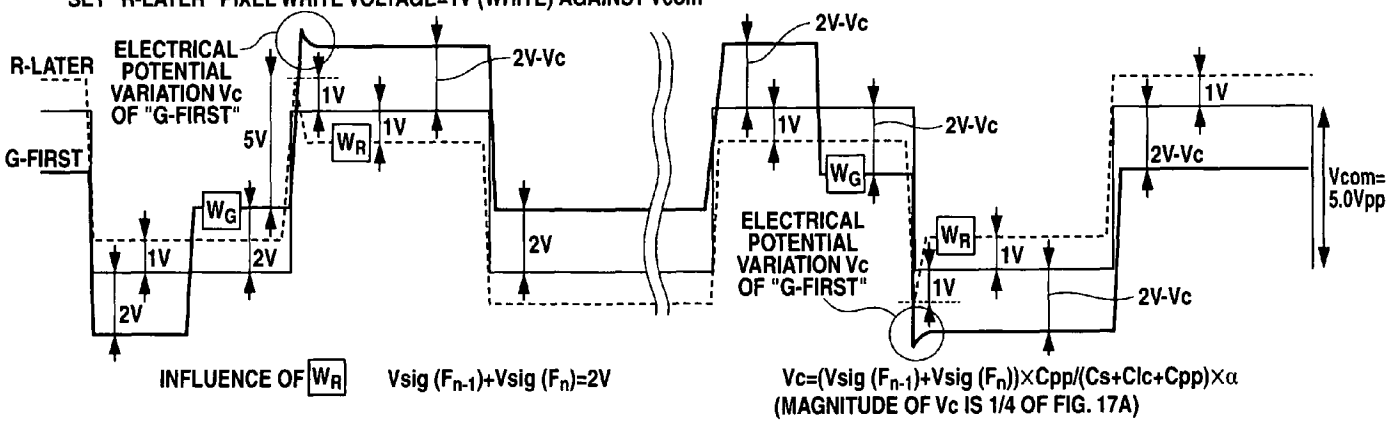
FIG.17B PRIOR ART
FIG. 17B is a view depicting pixel electrical potential waveforms, in which amplitude of a common voltage is set to 5.0V, a write voltage of a pixel G-first is set to 2.0V against the common voltage, and a write voltage of pixel R-later is set to 1.0V against the common voltage, in performing the dot inversion driving, taking inter-pixel parasitic capacitance into account.

(In the conventional case, the results of the equations are 8.0V and 2.0V in response to FIGS. 15A and 15B, respectively.)

In general, when the pixel voltage against the common voltage Vcom varies within a range of 1.0V (white)-4.0V (black), "Vsig($F_{n-1}$)+Vsig($F_n$)" in Eq. (1) is within 2.0V to 8.0V, and "Vsig(X2)−Vsig(X1)" in Eq. (2) is within −3.0V to 3.0V.

Thus, in the first embodiment, since the absolute value of the electrical potential variation Vc is apt to be small, the display device can make the electrical potential variation Vc caused from the inter-pixel parasitic capacitance Cpp smaller than the conventional technique, and the display device of the first can decrease the display unevenness.

If the electrical potential difference between adjacent pixels connected to the same signal line is large, for instance, if the write voltage of the G-first pixel Fg is 4.0V (black) against the common voltage Vcom, the write voltage of the R-later pixel Lr is 1.0V (white) against the common voltage Vcom, and the write voltage of the B-first pixel Fb is 4.0V (black) against the common voltage Vcom, the display device of the embodiment makes the electrical potential variation Vc becomes larger than that of the conventional display device sometimes.

$$(Vsig(X2)-Vsig(X1)=1.0-4.0=-3.0V$$

$$Vsig(F_{n-1})+Vsig(F_n)=1.0+1.0=2.0V)$$

However, in this case, the G-first pixel Fg to be affected is a sufficiently saturated black level, and the variation Vc is not originally visible on the display, and therefore the variation Vc does not come into question. The R-later pixel Lr and the B-first pixel Fb are in the white level, and the black level, respectively, and the screen display in this case becomes a significantly bright R raster screen, and therefore it is more difficult to view the variation Vc at G-first. Therefore, although the absolute value of the variation Vc in this embodiment becomes larger than that of the conventional technique in some cases, in such cases, this embodiment does not have any harmful effects from a practical standpoint.

Since the up-and-down shift only turns around the scanning direction, the display device of the first embodiment can make the electrical potential variation Vc caused by the inter-pixel parasitic capacitance Cpp more minute than the conventional technique, and can decrease the display unevenness, in the up-and-down inversion shift driving as well.

If necessary, the display device may switch between the normal mode using the conventional technique described in the Background of the Invention section and the gate write-twice mode of the first embodiment by means of the GDOUBLE signal.

In such a case, the display device can appropriately correspond to the case of the aforementioned particular display screen.

Although the description above mentions the case of the horizontal line inversion driving, even in the case of quasi-dot inversion driving (dot inversion driving of delta arrangement corresponding to dot inversion driving of stripe arrangement), the display device can similarly make the electrical potential variation Vc caused from the inter-pixel parasitic capacitance Cpp minute in comparison to the conventional technique and can reduce the display unevenness.

The first embodiment is not limited to the case of the delta arrangement of the pixels 16, and is also applicable to the case of the stripe arrangement of the pixels.

Figure 13:
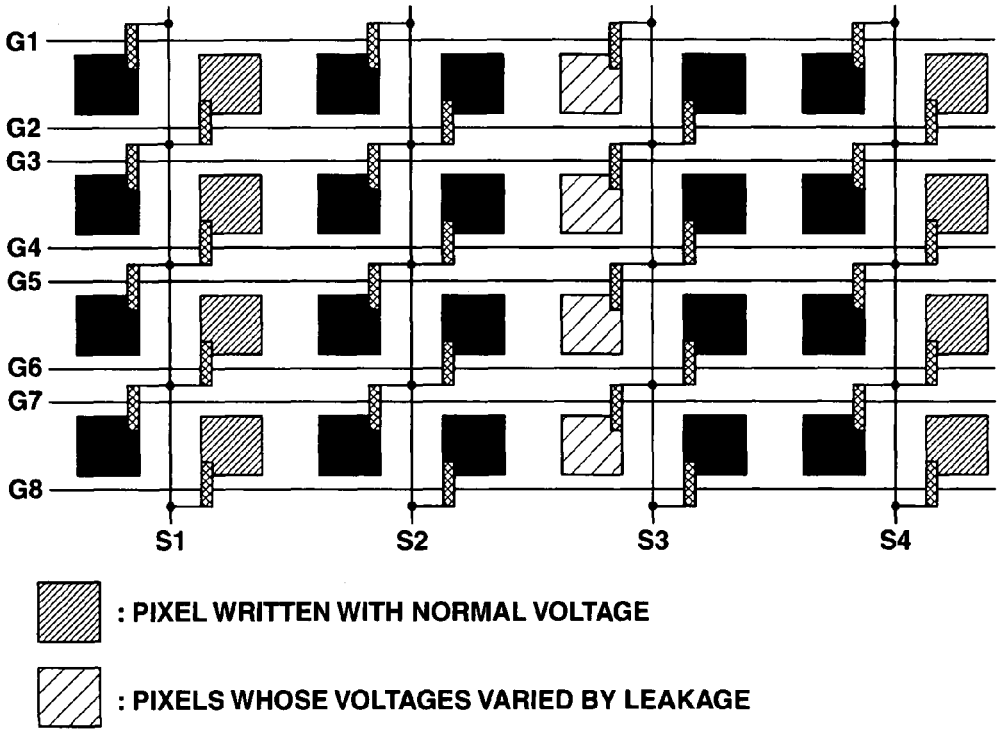
FIG.13 PRIOR ART
FIG. 13 is a view depicting an example of display unevenness on the display panel of FIG. 10.
Figure 14:
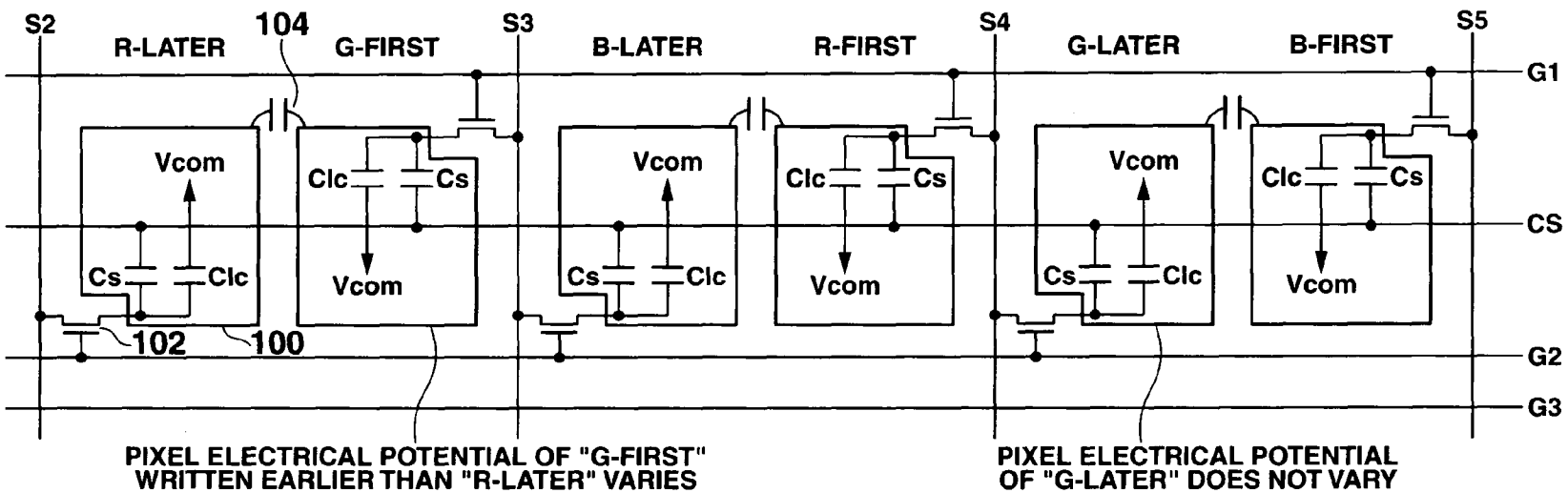
FIG.14 PRIOR ART
FIG. 14 is a view depicting configurations of respective pixels when a TFT LCD panel is used as the display panel.

The delta arrangement of the pixels 16 makes the display unevenness (e.g., longitudinal strip corresponding to FIG. 13) meander. In comparison with the longitudinal-stripe display unevenness which may appear in the case of the strip arrangement, the meandering display unevenness is advantageous in that it suppresses the feeling of visual strangeness.

Second Embodiment

The second embodiment writes a first write pixel electrical potential after adding thereto the electrical potential variation Vc caused by the inter-pixel parasitic capacitance Cpp. In this way, the electrical potential variation Vc caused by the inter-pixel parasitic capacitance Cpp is canceled to eliminate display unevenness.

Here, consideration will be given as to how the potential variation is corrected using the γ circuit block 30 of the driver circuit 12. Reference will be made to a still image in which display unevenness is conspicuous.

Figure 5:
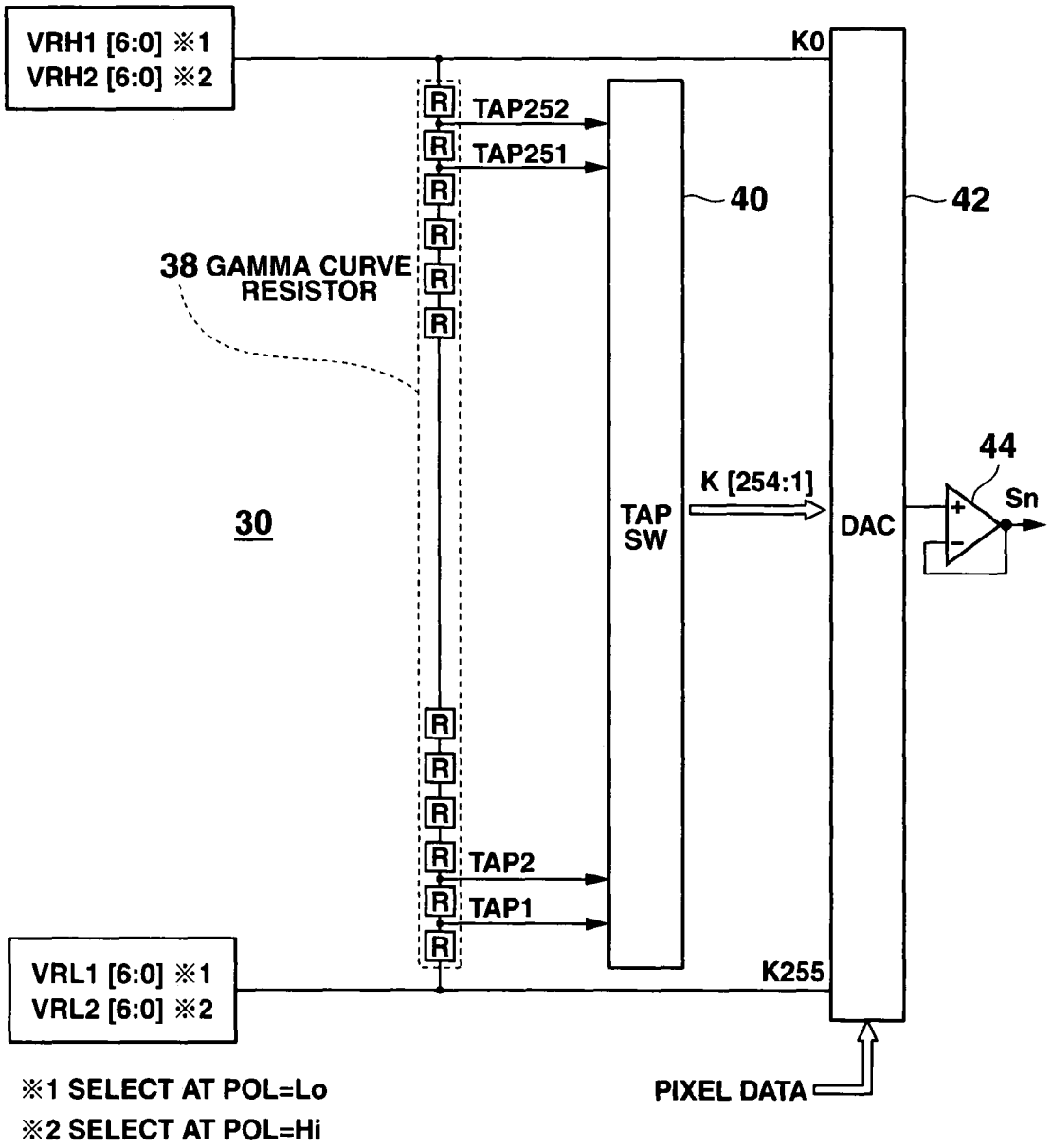
FIG. 5 is a view depicting a circuit configuration of a γ circuit block in a matrix display device regarding the second embodiment of the invention.

As shown in FIG. 2, the driver circuit 12 includes the γ circuit block 30. FIG. 5 depicts the circuit configuration of the block 30. As depicted in FIG. 5, the block 30 is composed of a γ curved line resistor 38 and a tap switch (TAPSW) 40. The resistor 38 is tapped so as to extract electrical potentials corresponding to the γ curved line, and the TAPSW 40 applies a voltage value corresponding to a level of gradation for pixel data to the source driver block 24. The driver block 24 includes a digital-to-analog conversion circuit (DAC) 42 and a source output amplifier 44. The DAC 42 converts the voltage value corresponding to a level of gradation for the pixel data into an analog signal, and outputs it as a write voltage (video signal Vsig) to the corresponding source line of the LCD panel 10 through the source output amplifier 44. Amplitude adjustment signals VRH1, VRH2, VRL1 and VRL2 that are input to the block 30 are switched by the polarity of POL (inverted common voltage Vcom) and supplied from the TG unit logic circuit 28.

FIG. 6A shows a γ curve of the γ circuit block 30 when POL is L, namely when the common voltage Vcom is H, and FIG. 6B is a γ curve of the γ circuit block 30 when POL is H, namely when the common voltage Vcom is L. In FIGS. 6A and 6B, the γ curve "without compensation" indicates the curve in a normal mode not to compensate for the electrical potential variation Vc in the second embodiment. In contrast, the γ curve "with compensation" may be selected in a mode to compensate for the electrical potential variation Vc (data shift mode). The γ curve "with compensation" is the γ curve "without compensation" shifted by a fixed value in a direction so as not to change the gradient and amplitude of the γ curve "without compensation" but so as to simply brighten it (the direction to heighten output voltage in FIG. 6A, and to lower output voltage in FIG. 6B).

The fixed value is a value that enables compensation of the potential variation Vc which may occur in the gradation level (an intermediate gradation level) where display unevenness is conspicuous. The fixed value is equivalent to the electrical potential variation Vc in the case where "$Vsig(F_{n-1})=Vsig(F_n)$" in Eq. (1).

Figure 7A:
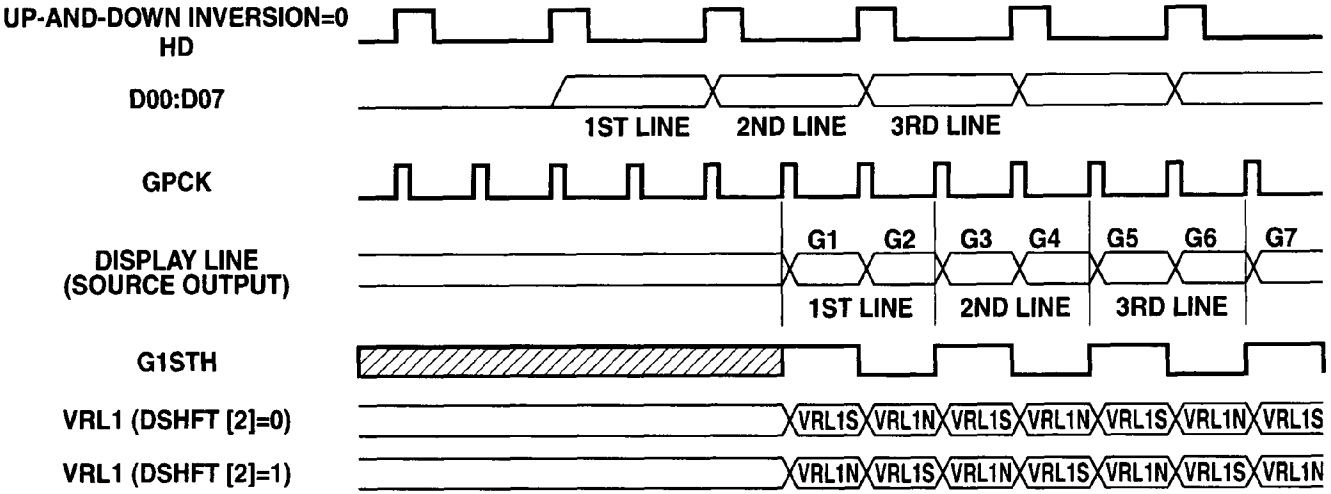
FIG. 7A is a view depicting a timing chart in a non-inversion shift mode.

FIG. 6C shows relationships of the output voltages to the amplitude adjustment signals VRH1, VRH2, VRL1 and VRL2 in the data shift mode, and FIG. 6D shows a shift amount. FIG. 7A shows a timing chart in non-inversion shift, and FIG. 7B shows a timing chart in up-and-down inversion shift.

It is very easy to create such a γ curve of "with compensation" because it is enough only to set a voltage in which the voltage on an upper side and the voltage on a lower side are shifted by a fixed value.

Figure 7B:
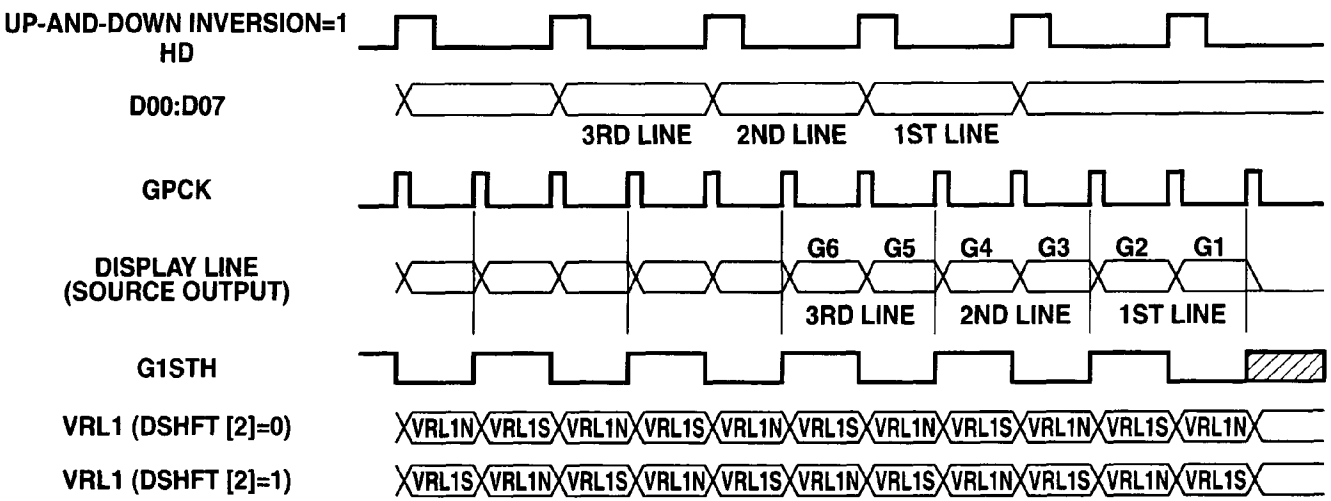
FIG. 7B is a view depicting a timing chart in an up-and-down inversion shift mode.

As depicted in FIGS. 6C, 7A and 7B, the matrix display device of the second embodiment selects two gate lines in turn for one horizontal period in the same manner as the conventional matrix display device, and the write voltage (video signal Vsig) corresponding to the selected gate line is output. At that time, in the γ circuit block 30, the write voltage corresponding to one gate line is set using the γ curve "without compensation", and the write voltage corresponding to the other gate line is set using the γ curve "with compensation". The γ circuit block 30 determines the switching timing of the gate lines by a G1STH signal that is a signal of which the first half of one horizontal period is H and the second half thereof is L and that is supplied from the TG unit logic circuit 28.

The TG unit logic circuit 28 enters the data shift signal DSHIFT to the circuit block 30. As shown in FIG. 6D, the LSB 2-bit of the data shift signal DSHIFT sets a shift amount. In the second embodiment, the γ curve "with compensation" is applied to the write voltages described above.

As described above, the write voltages vary in such a manner as to increase the potential difference between the common voltage Vcom and the write voltages in the horizontal line inversion driving, and vary in such a manner as to decrease the potential difference between the common voltage Vcom and the write voltages in the dot inversion driving. It is therefore desired that a γ curve "with compensation" to be used for the horizontal line inversion driving and a γ curve "with compensation" to be used for the (quasi) dot inversion driving be stored in advance, and that an appropriate γ curve be selected and used in accordance with the driving method in use.

Figure 8A:
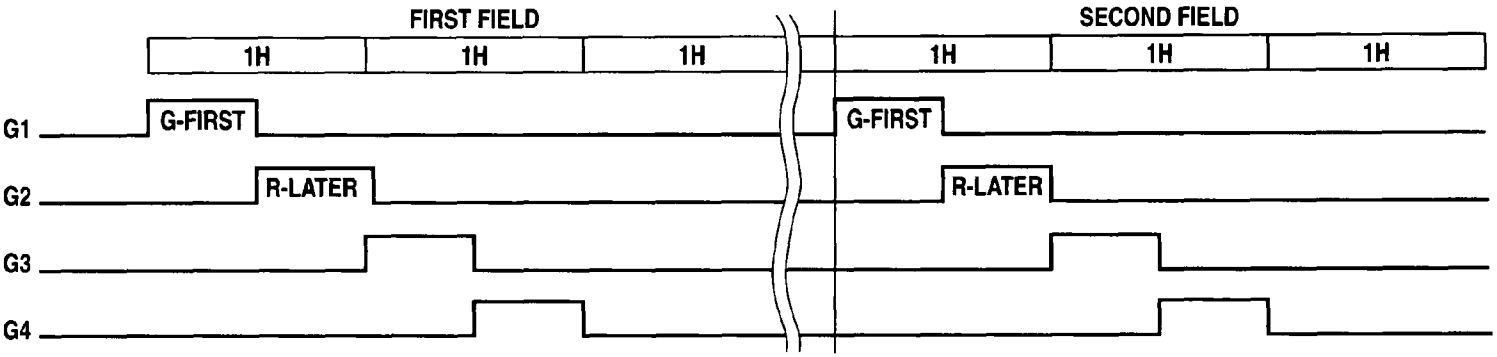
FIG. 8A is a view depicting a scanning timing chart in the non-inversion shift mode in the data shift mode.

FIG. 8A shows a scanning timing chart in non-inversion shift in the data shift mode of the embodiment corresponding to FIG. 15A. At this time, in FIG. 8A, like the timing chart in FIG. 15A, two gate lines are selected in turn for one horizontal period for each field and the selected two gate lines are scanned in turn for every horizontal period.

Figure 8B:
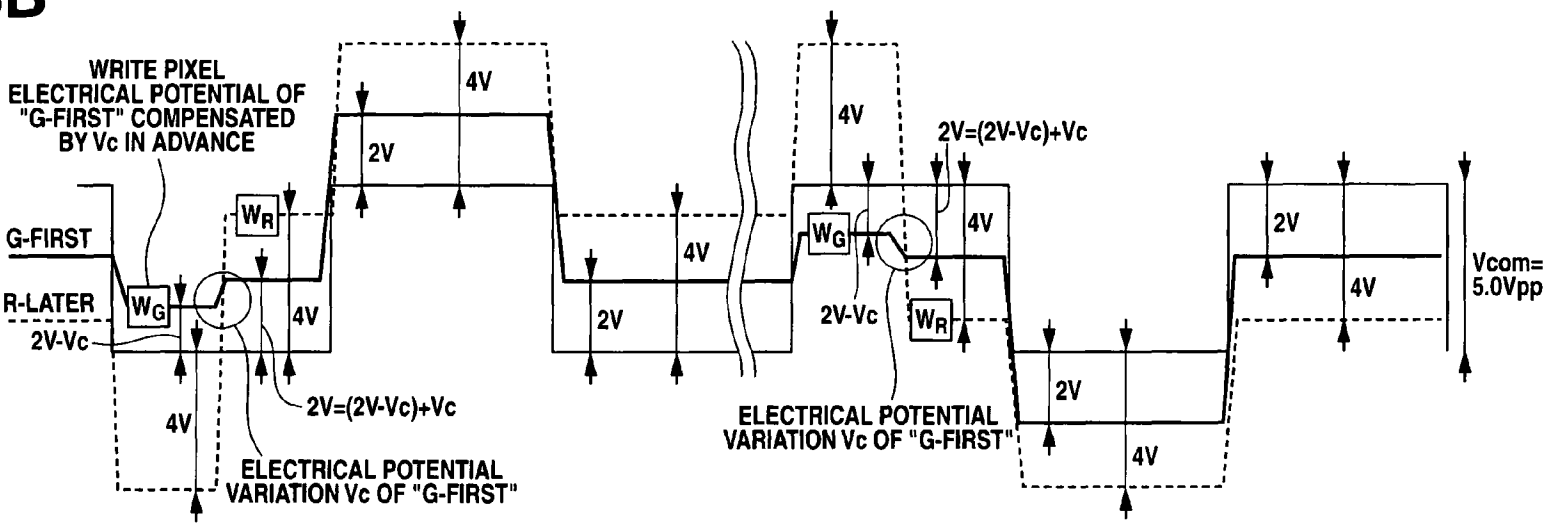
FIG. 8B is a view depicting pixel electrical potential waveforms in the case in which an amplitude of a common voltage is set to 5.0V, a write voltage of a pixel G-first is set to 2.0V against the common voltage, and a write voltage of pixel R-later is set to 4.0V against the common voltage, in performing the horizontal line inversion driving.

FIG. 8B shows pixel electrical potential waveforms in the case in which the amplitude of the common voltage Vcom is set to 5.0V, the write voltage (video signal Vsig) of the G=first pixel Fg is set to 2.0V (intermediate tone) against the common voltage Vcom, and the write voltage (video signal Vsig) of the R-later pixel Lr is set to 4.0V (black) against the common voltage Vcom when performing the horizontal line inversion driving.

In this case, by means of MSB 1-bit of the data shift signal DSHIFT, the γ curve "with compensation" is employed for the write voltage for the first writing.

Accordingly, for the G-first pixel Fg in the first field, POL=H, namely Vcom=L being realized, the γ curve "with compensation" of VRH2S as VRH2, and of VRL2S as VRL2 is applied, and the write voltage (video signal Vsig) of the G-first pixel Fg becomes 2.0V−Vc (rather than 2.0V) against the common voltage Vcom. For the R-later pixel Lr, the γ curve "without compensation" of VRH2N as VRH2, and VRL2N as VRL2 is applied, and the write voltage (video signal Vsig) of the R-later pixel Lr becomes 4.0V against the common voltage Vcom. In writing the R-later pixel Lr, the electrical potential of the G-first pixel Fg varies by Vc due to the inter-pixel parasitic capacitance Cpp, and as a result the voltage of the G-first pixel Fg becomes (2.0V−Vc)+Vc, resulting in the desired pixel electrical potential of 2.0V against the common voltage Vcom.

In the second field, POL=L, namely Vcom=H being established, for the G-first pixel Fg, the γ curve "with compensation" of VRH1S as VRH1, and VRL1S as VRL1 is employed, and the write voltage (video signal Vsig) of the G-first pixel Fg is 2.0V−Vc (instead of 2.0V) against the common voltage Vcom. For the R-later pixel Lr, the γ curve "without compensation" of VRH1N as VRH1, and VRL1N as VRL1 is employed, and the write voltage (video signal Vsig) of the R-later pixel Lr becomes 4.0V against the common voltage Vcom. In writing the R-later pixel Lr, the electrical potential of the G-first pixel Fg varies by Vc due to the inter-pixel parasitic capacitance Cpp to become (2.0V−Vc)+Vc, and results in the desired pixel electrical potential of 2.0V against the common voltage Vcom.

In this manner, writing the pixel electrical potential of first writing due to the inter-pixel parasitic capacitance Cpp allows canceling the electrical potential variation Vc due to the inter-pixel parasitic capacitance Cpp and eliminating the display unevenness. Further, the use of the γ circuit block 30 of the driver circuit 12 enables advantageous effects in a simple manner.

Modified Example of Second Embodiment

Figure 9A:
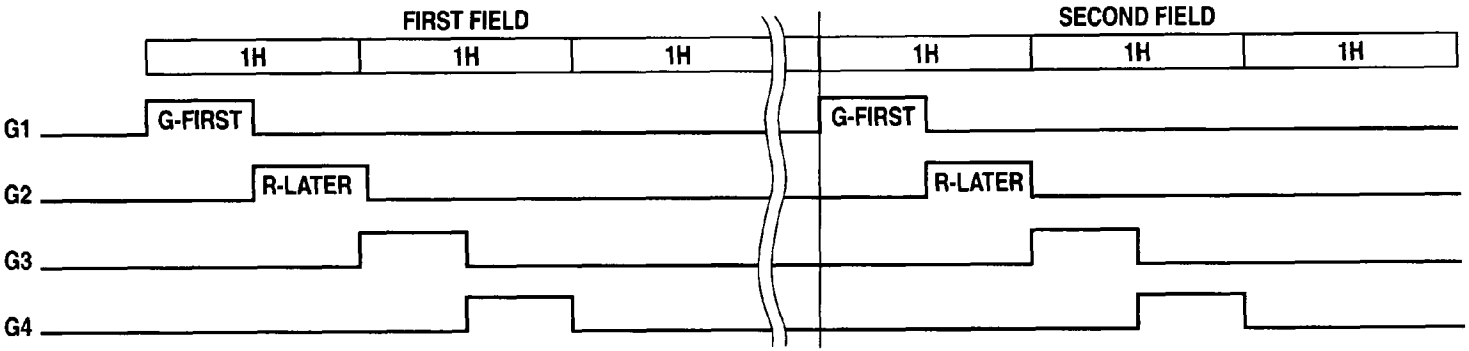
FIG. 9A is a view depicting a scanning timing chart in the non-inversion shift mode in the data shift mode.
Figure 9B:
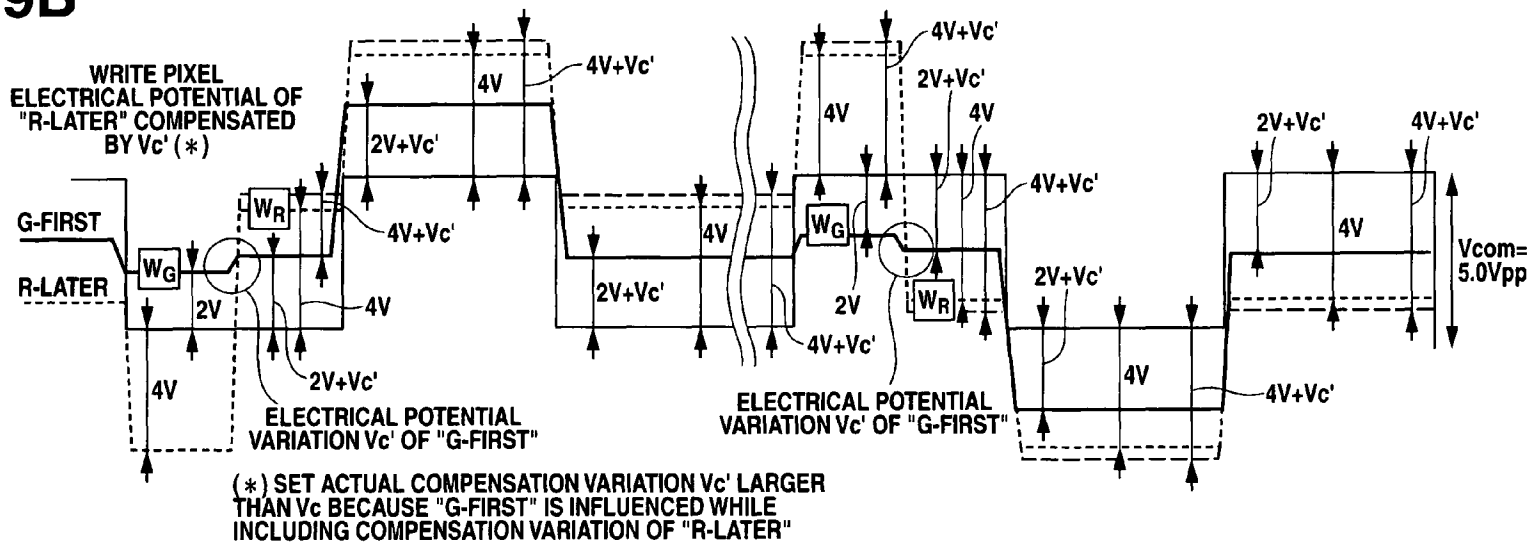
FIG. 9B is a view depicting pixel electrical potential waveforms in the case in which an amplitude of a common voltage is set to 5.0V, a write voltage of a pixel G-first is set to 2.0V against the common voltage, and a write voltage of pixel R-later is set to 4.0V against the common voltage, in performing the horizontal line inversion driving.
Figure 10:
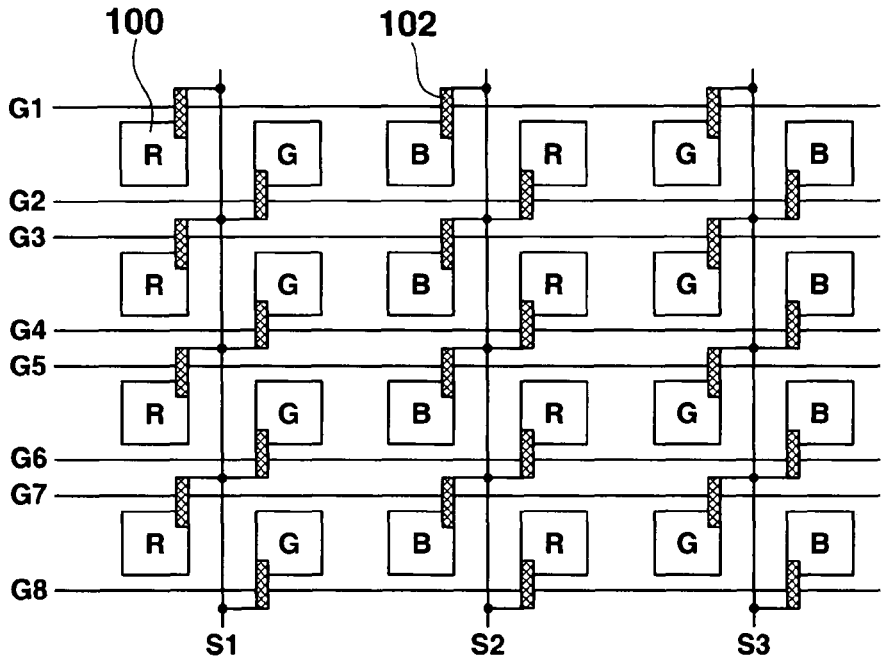
FIG.10 PRIOR ART
FIG. 10 is a schematic view depicting pixel wiring lines on a display panel when the number of source lines of a conventional matrix display device us reduced by half.
Figure 11:
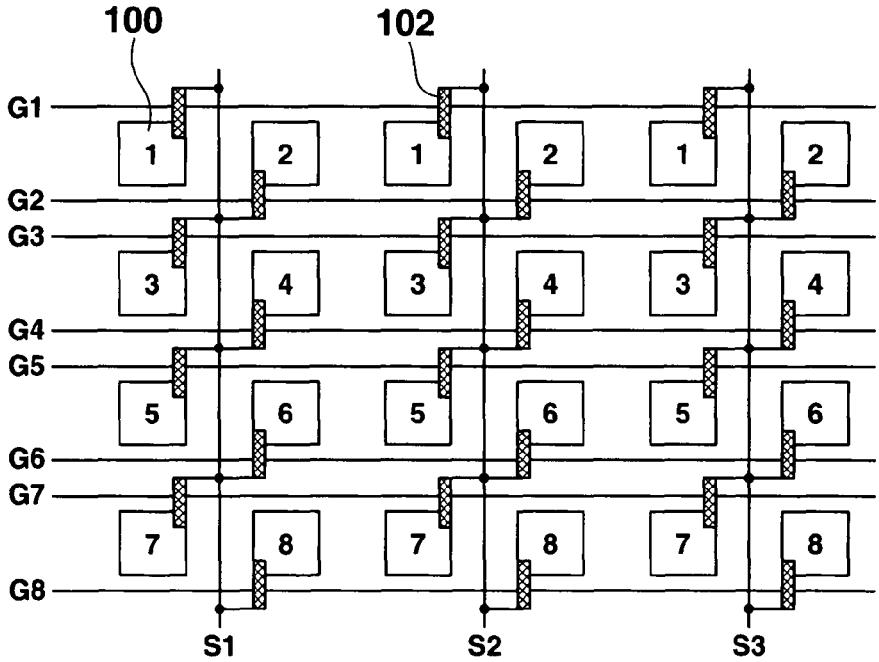
FIG.11 PRIOR ART
FIG. 11 is a view depicting an order of writing video signals to each pixel with the pixel wiring lines of FIG. 10.
Figure 12:
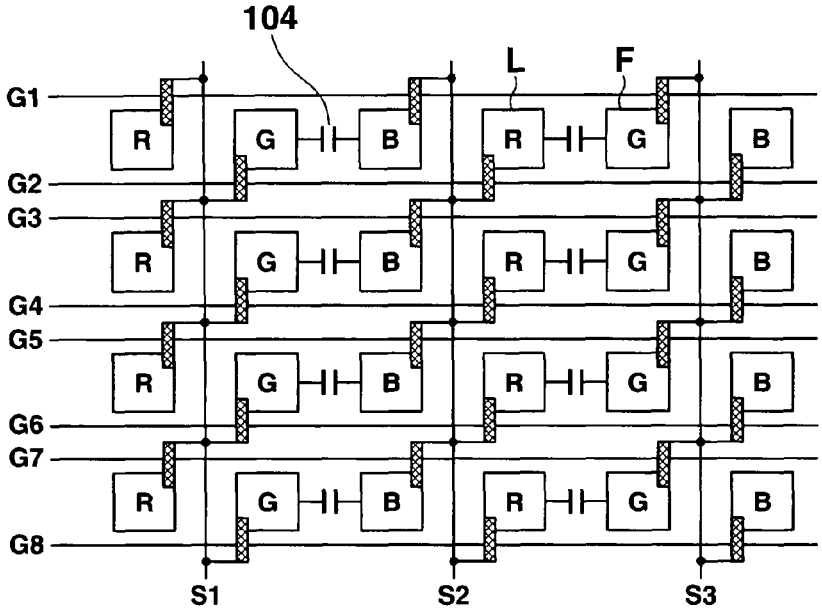
FIG.12 PRIOR ART
FIG. 12 is a view depicting an equivalent circuit of a display panel of FIG. 10.

While the second embodiment is configured to cancel the electrical potential variation Vc caused by the inter-pixel parasitic capacitance Cpp by writing the pixel electrical potential of first writing after adding electrical potential variation Vc caused from the inter-pixel parasitic capacitance Cpp, the display device may also eliminate the display unevenness in the manner shown in FIGS. 9A and 9B.

Similar to FIG. 8A, FIG. 9A is a view illustrating a scanning timing chart in a non-inversion shift in a data shift mode. FIG. 9B is a view illustrating pixel electrical potential waveforms in the case in which the amplitude of the common voltage Vcom is set to 5.0V, the write voltage (video signal Vsig) of the G-first pixel Fg is set to 2.0V (intermediate tone) against the common voltage Vcom, and the write voltage (video signal Vsig) of the R-later pixel Lr is set to 4.0V (black) against the common voltage Vcom when the horizontal line inversion driving is performed.

A modified example of the second embodiment, as shown in FIG. 9B, adds the electrical potential variation Vc' caused by the first write pixel to the later write pixel potential. By shifting both the first write pixel and the later write pixel from the originally intended positions by Vc', the second embodiment is intended to eliminate at least display unevenness. (In this case, the potential variation Vc' caused in the first write pixel potential differs from the potential variation Vc generated in the second embodiment by the potential added to the later write pixel potential. To be more specific, the voltage corresponding to the shift is expressed by:

$$\text{“}1/(1-(Cpp/(Cs+Clc+Cpp)\times\alpha))\times Vc.\text{)”}$$

In this case, the entire screen becomes an image which has been shifted by the electrical potential variation Vc' due to the inter-pixel parasitic capacitance Cpp; however, the electrical potential variation Vc' having originally been smaller voltage than the write voltage by approximately two figures, if the voltage of the entire screen shifts, no practical obstacle occurs.

In this case as well, the use of the block 30 of the driver circuit 12 enables advantageous effects in a simple manner. In the present embodiment, MSB 1-bit of the data shift signal DSHIFT is set such that the γ curve “with compensation” is applied to the later write voltage.

In this manner, compensation is performed in such a manner that the compensation level is a gradation level (intermediate level) at which unevenness is conspicuous. With this feature, display unevenness can be corrected using a simple circuit.

Further, since the compensation amounts (as depicted in FIG. 6D) can be switched easily, the display device of the second embodiment can flexibly deal with liquid crystals differing in inter-pixel parasitic capacitance.

Since the display device enables easily changing the compensation directions (as shown in FIGS. 6A, 6B, 6C, 6D, 7A, and 7B) in response to the method of driving (i.e. in response to changing between the non-inversion and up-and-down inversion mode), the display device may flexibly correspond with a variety of driving modes including the polarity inversion mode.

As mentioned above, the second embodiment uses the γ circuit block 30 to solve the problem of the display unevenness caused by the electrical potential variation to be generated at the first-written pixel resulting from the inter-pixel parasitic capacitance. Therefore, there is no need to unnecessarily mount a new circuit, and an even and excellent display is achieved with a reduced space and at a low cost.

While the invention has described on the basis of specific embodiments, the invention is not limited to the specific details and representative embodiments shown and described herein, and in an implementation phase, this invention may be embodied in various forms without departing from the spirit or scope of the general inventive concept thereof.

For example, it is acceptable to combine the method of gate write-twice in the first embodiment and the method of data shift in the second embodiment.

Moreover, although the second embodiment is described above as using the γ circuit block to compensate for the pixel electrical potential variation, it is obvious that the compensation may be performed by means of other circuits prepared for the purpose of the compensation.

While the second embodiment described above is configured to shift the compensation voltage by a fixed value regardless of its gradations, the display device may calculate the compensation amount equivalent to Eq. (1) to generate an appropriate compensation voltage. Also in such a case, the display device can be easily realized by using the γ circuit block 30 and by switching the manner of selection on the TAPSW 40 for the γ curve resistor in response to the gradations. For example, to correspond to a moving image: $Vsig(F_{n-1})\neq Vsig(F_n)$, the use of a circuit including a field memory is useful.

The case of a normally white liquid crystal is described above, but the present invention is also applicable in a similar manner to a normally black liquid crystal, in which the larger the voltage applied on a pixel is, the higher (brighter) the transmission factor becomes, because only the directions of light and shade are reversed.

Further, it goes without saying that the switching elements are not limited to the TFTs, but diodes, etc., are useful. Since the pixels of the matrix display device are not limited to liquid crystals as long as capacitive elements and inter-pixel parasitic capacitance are present, the invention can reduce the display unevenness similarly.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An active matrix type display device comprising:

a first signal line and a second signal line arranged adjacent to each other along a given direction, wherein the signal lines are adapted to have video signals of a plurality of gradations applied thereto;

a first pixel and a second pixel arranged between the first signal line and the second signal line and arranged adjacent to each other along the given direction;

a third pixel arranged adjacent to the first pixel with the first signal line interposed between the first pixel and the third pixel and shared by the first pixel and the third pixel;

a fourth pixel arranged adjacent to the second pixel with the second signal line interposed between the second pixel and the fourth pixel and shared by the second pixel and the fourth pixel;

a first scanning line to which the first pixel and the fourth pixel are connected;

a second scanning line to which the second pixel and the third pixel are connected; and a compensation circuit which causes only one pixel out of the first pixel and the second pixel to output a compensation video signal in which a signal compensation amount corresponding to a potential variation component is added or subtracted to compensate a video signal for the pixel, the potential variation component originating from an inter-pixel parasitic capacitance formed by the first and second pixels and generated between the first and second pixels when video signals of a same gradation are supplied via the first and second signal lines;

wherein the compensation circuit, upon causing one of the first pixel and the second pixel to output the compensation video signal, causes the other of the first pixel and the second pixel to output a video signal that is not compensated by the signal compensation amount; and wherein the signal compensation amount is set to a constant value corresponding to the potential variation component generated when a gradation of a video signal is an intermediate tone, regardless of gradation values of the video signals applied to the first and second signal lines.

2. The display device according to claim 1, wherein the compensation circuit uses at least a part of a gamma compensation circuit to perform gamma compensation for gradations to cause said only one of the first pixel and the second pixel to output the compensation video signal.

3. The display device according to claim 1, wherein the constant value of the signal compensation amount is selected from previously set values to set the constant value.

4. The display device according to claim 1, wherein a compensation direction of the video signal is switchable in response to a method of driving.

5. The display device according to claim 1, wherein the compensation circuit causes a pixel to be selected first out of the first pixel and the second pixel to output the compensation video signal.

6. The display device according to claim 1, wherein the compensation circuit causes a pixel to be selected later out of the first pixel and the second pixel to output the compensation video signal.

7. The display device according to claim 1, wherein the intermediate tone is a gradation halfway between a minimum gradation and a maximum gradation of the video signal.

8. An active matrix type display device comprising:

a first signal line and a second signal line arranged adjacent to each other along a given direction, wherein the signal lines are adapted to have video signals of a plurality of gradations applied thereto;

a first pixel and a second pixel arranged between the first signal line and the second signal line and arranged adjacent to each other along the given direction;

a third pixel arranged adjacent to the first pixel with the first signal line interposed between the first pixel and the third pixel and shared by the first pixel and the third pixel;

a fourth pixel arranged adjacent to the second pixel with the second signal line interposed between the second pixel and the fourth pixel and shared by the second pixel and the fourth pixel;

a first scanning line to which the first pixel and the fourth pixel are connected;

a second scanning line to which the second pixel and the third pixel are connected; and a compensation circuit which causes a compensation signal, in which a signal compensation amount corresponding to a potential variation component is added or subtracted to compensate a video signal for the first pixel, to be output at a timing of selecting the first pixel, and causes a video signal that is not compensated by the signal compensation amount to be output at a timing of selecting the second pixel, the potential variation component originating from an inter-pixel parasitic capacitance formed by the first and second pixels and generated between the first and second pixels when video signals of a same gradation are supplied via the first and second signal lines; and wherein the signal compensation amount is set to a constant value corresponding to the potential variation component generated when a gradation of a video signal is an intermediate tone, regardless of gradation values of the video signals applied to the first and second signal lines.

9. The display device according to claim 8, wherein the intermediate tone is a gradation halfway between a minimum gradation and a maximum gradation of the video signal.

10. An active matrix type display device comprising:

a first signal line and a second signal line arranged adjacent to each other along a given direction, wherein the signal lines are adapted to have video signals of a plurality of gradations applied thereto;

a first pixel and a second pixel arranged between the first signal line and the second signal line and arranged adjacent to each other along the given direction;

a third pixel arranged adjacent to the first pixel with the first signal line interposed between the first pixel and the third pixel;

a fourth pixel arranged adjacent to the second pixel with the second signal line interposed between the second pixel and the fourth pixel;

a first scanning line and a second scanning line arranged to cross the first signal line and the second signal line;

a first thin film transistor which includes a gate electrode connected to the first scanning line, a source electrode, and a drain electrode, wherein one of the source electrode and the drain electrode is connected to the first pixel, and the other of the source electrode and the drain electrode is connected to the first signal line;

a second thin film transistor which includes a gate electrode connected to the second scanning line, a source electrode, and a drain electrode, wherein one of the source electrode and the drain electrode is connected to the second pixel, and the other of the source electrode and the drain electrode is connected to the second signal line;

a third thin film transistor which includes a gate electrode connected to the second scanning line, a source electrode, and a drain electrode, wherein one of the source electrode and the drain electrode is connected to the third pixel and the other of the source electrode and the drain electrode is connected to the first signal line;

a fourth thin film transistor which includes a gate electrode connected to the first scanning line, a source electrode, and a drain electrode, wherein one of the source electrode and the drain electrode is connected to the fourth pixel, and the other of the source electrode and the drain electrode is connected to the second signal line; and a compensation circuit which causes only one pixel out of the first pixel and the second pixel to output a compensation video signal in which a signal compensation amount corresponding to a potential variation component is added or subtracted to compensate a video signal for the pixel, the potential variation component originating from an inter-pixel parasitic capacitance formed by the first and second pixels and generated between the first and second pixels when video signals of a same gradation are supplied via the first and second signal lines;

wherein the compensation circuit, upon causing one of the first pixel and the second pixel to output the compensation video signal, causes the other of the first pixel and the second pixel to output a video signal that is not compensated by the signal compensation amount; and wherein the signal compensation amount is set to a constant value corresponding to the potential variation component generated when a gradation of a video signal is an intermediate tone, regardless of gradation values of the video signals applied to the first and second signal lines.

11. The display device according to claim 10, wherein the compensation circuit causes the video signal compensated by the signal compensation amount to be output from a signal line driving circuit when one of the first scanning line and the second scanning line is selected by a scanning line driving circuit, and causes the video signal not compensated by the signal compensation amount to be output from the signal line driving circuit when the other line is selected by the scanning line driving circuit.

12. The display device according to claim 10, wherein the intermediate tone is a gradation halfway between a minimum gradation and a maximum gradation of the video signal.

* * * * *